US008300074B2

(12) United States Patent
Fujise et al.

(10) Patent No.: US 8,300,074 B2
(45) Date of Patent: Oct. 30, 2012

(54) EXPOSING DEVICE FOR CONTROLLING THE EXPOSURE OF A PHOTOCONDUCTOR

(75) Inventors: Masaki Fujise, Ebina (JP); Yasuhiro Arai, Ebina (JP); Kenji Koizumi, Ebina (JP); Hayato Yoshikawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 407 days.

(21) Appl. No.: 12/569,419

(22) Filed: Sep. 29, 2009

(65) Prior Publication Data

US 2010/0225729 A1 Sep. 9, 2010

(30) Foreign Application Priority Data

Mar. 5, 2009 (JP) ..... 2009-051590

(51) Int. Cl.
*B41J 2/435* (2006.01)
*B41J 2/47* (2006.01)

(52) U.S. Cl. ..... 347/224; 347/234

(58) Field of Classification Search ..... 347/234, 347/224; 372/38.02
See application file for complete search history.

(56) References Cited

U.S. PATENT DOCUMENTS

2006/0023761 A1* 2/2006 Moriyama ..... 372/38.02

FOREIGN PATENT DOCUMENTS

JP 2001-264673 A 9/2001
JP 2001264673 * 9/2001

* cited by examiner

*Primary Examiner* — Stephen Meier
*Assistant Examiner* — Carlos A Martinez
(74) *Attorney, Agent, or Firm* — Sughrue Mion, PLLC

(57) ABSTRACT

An exposing device includes a plurality of exposing units which forms a latent image, wherein exposing units includes: an exposure light source; a rotating polyhedron that reflects light from the exposure light source; a driving source that rotates the rotating polyhedron; a first detecting unit that detects the number of rotations of the driving source; a second detecting unit that detects the light from the exposure light source at a position; and a control unit that performs a first control of the driving source based on a detection signal of the first detecting unit at a start of the rotation of the rotating polyhedron and thereafter performs a second control of the driving source based on a detection signal of the second detecting unit.

11 Claims, 29 Drawing Sheets

EXPOSING DEVICE FOR CONTROLLING THE EXPOSURE OF A PHOTOCONDUCTOR

CROSS-REFERENCE TO RELATED APPLICATION

This application is based on and claims priority under 35 USC 119 from Japanese Patent Application No. 2009-051590 filed on Mar. 5, 2009.

BACKGROUND

Technical Field

The present invention relates to an exposing device, an image forming apparatus and computer readable medium for controlling an exposure.

SUMMARY

According to an aspect of the invention, an exposing device includes a plurality of exposing units which forms a latent image, wherein each of the plurality of exposing units includes: an exposure light source; a rotating polyhedron that reflects light from the exposure light source to exposedly scan a photoconductor with the reflected light while rotating; a driving source that rotates the rotating polyhedron; a first detecting unit that detects the number of rotations of the driving source; a second detecting unit that detects the light from the exposure light source at a position, the light being reflected by the rotating polyhedron; a control unit that performs a first control of the driving source based on a detection signal of the first detecting unit at a start of the rotation of the rotating polyhedron and thereafter performs a second control of the driving source based on a detection signal of the second detecting unit; and the exposing device includes a process performing unit that performs a process if a phase difference between the detection signal of the second detecting unit of each of the exposing units and a predetermine signal has no relationship when the first control is switched over to the second control by the control unit of the exposing unit.

BRIEF DESCRIPTION OF THE DRAWINGS

Exemplary embodiments of the invention will be described in detail based on the following figures.

DETAILED DESCRIPTION

Hereinafter, one exemplary embodiment of the present invention will be described.

Figure 1:
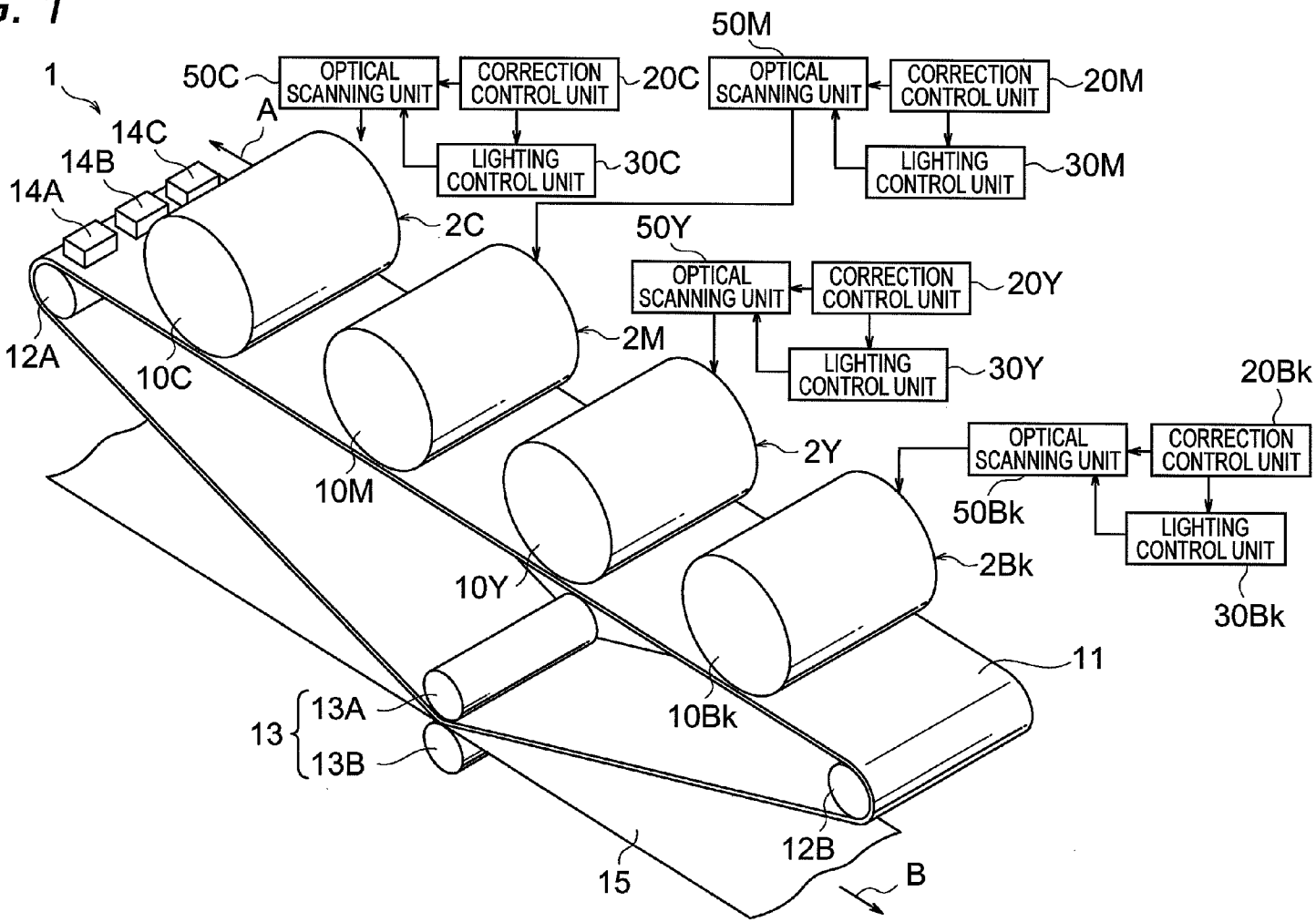
FIG. 1 is an explanatory view of an image forming apparatus according to one exemplary embodiment of the present invention.

FIG. 1 is an explanatory view of an image forming apparatus according to this exemplary embodiment.

An image forming apparatus 1 includes photoconductors 10 on which toner images are formed on the surface thereof, a transfer belt 11, carrying rollers 12 (12A and 12B) which carry the transfer belt 11 in a predetermined direction, rollers 13 (13A and 13B) which carry the transfer belt 11 and transfer the toner image onto a sheet 15, and image position detecting sensors 14 (14A, 14B and 14C) which detect a position of a final toner image.

The image forming apparatus 1 is an apparatus for forming a color image and has the photoconductor 10 (10C, 10M, 10Y and 10Bk) corresponding to four colors of cyan (C), magenta (M), yellow (Y) and black (Bk) and four image forming parts 2 (2C, 2M, 2Y and 2Bk) which form cyan, magenta, yellow and black images on the photoconductors 10C, 10M, 10Y and 10Bk, respectively, using an electro-photographic process. That is, although not shown, the image forming apparatus 1 has devices, such as a charging unit, a developing unit, a transferring unit, a cleaner and so on, required for forming an image using the electro-photographic process around each photoconductor 10C, 10M, 10Y and 10Bk. In the following description, the above-mentioned letters, C, M, Y and Bk, are suffixed to reference numerals denoting devices constituting the image forming apparatus 1 only when various colors are required to be distinguished from each other, otherwise, the letters will be omitted.

The photoconductor 10 is charged by a charging unit and forms a latent image corresponding to an object image on its surface by irradiating it with a laser beam. This latent image is developed with toner of each color by a developing unit. That is, a toner image is formed on the surface of the photoconductor 10. The developing unit is charged with toner of cyan, magenta, yellow and black corresponding to each photoconductor 10. The toner image formed on the surface of the photoconductor 10 is transferred onto the transfer belt 11 by a transferring unit.

The transferring unit 11 is rotated by the carrying roller 12 and the roller 13 in a direction indicated by an arrow A of FIG. 1. The toner images formed on the surface of the photoconductor 10 are transferred onto the transfer belt 11 in turn. That is, the toner images of four colors of cyan, magenta, yellow and black are overlapped and transferred. The toner images overlapped and transferred in this manner are referred to as final toner images.

After completion of the transfer of the toner images onto the transfer belt 11, any toner remaining on the surface of the photoconductor 10 is removed by a cleaner. In addition, the photoconductor 10 is de-electrified by a de-electrifying lamp (not shown). In addition, a region along a width direction of the transfer belt 11 corresponds to an image scannable region in the photoconductor 10.

The rollers 13 are provided at a position opposing the photoconductor 10 with the transfer belt 11 interposed therebetween. The rollers 13 transfer the final toner image, which was transferred onto the carrying rollers 12, onto the sheet 15 discharged from a sheet tray (not shown) and carried in an arrow B direction. The final toner image transferred onto the sheet 15 is fixed by a fixing device (not shown). Thus, an image is formed on the sheet 15.

The image position detecting sensors 14 are provided downstream, that is, at a position lower than that of the photoconductor 10, in the carrying direction of the transfer belt 11. In addition, the image position detecting sensors 14A, 14B and 14C are provided to be perpendicular to the carrying direction. The image position detecting sensors 14 detect the position of the final toner image transferred onto the transfer belt 11.

In addition, in the image forming apparatus 1, an exposing unit is constituted by an optical scanning part 50 which forms a latent image by exposedly scanning the photoconductor 10 with a laser beam, a lighting control part 30 which controls lighting of the laser beam, and a correction control part 20 which corrects an exposure position when the photoconductor 10 is exposedly scanned.

Figure 2:
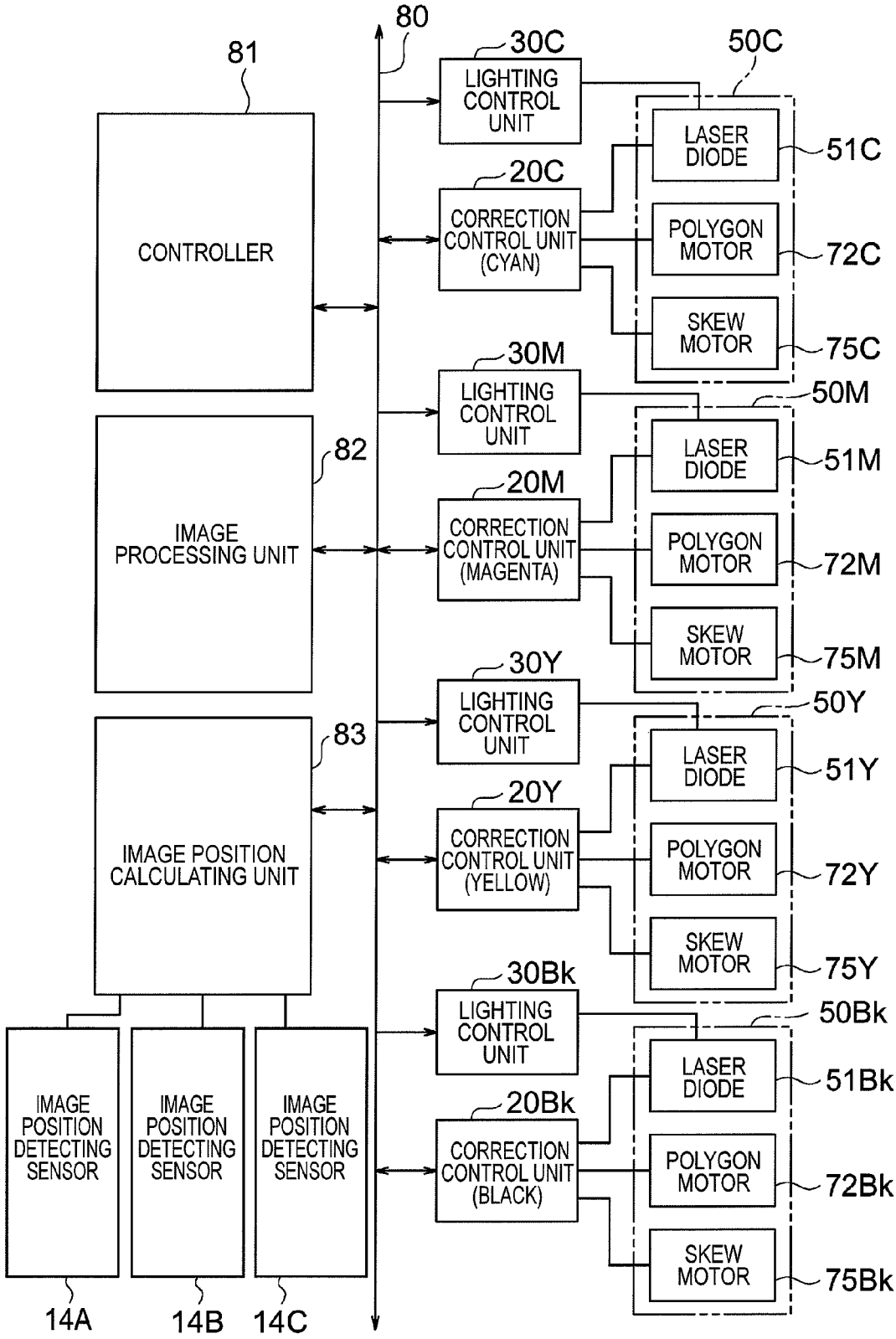
FIG. 2 is a block diagram showing an electrical connection of an exposing device of the image forming apparatus according to one exemplary embodiment of the present invention.

FIG. 2 is a block diagram showing an electrical connection of an exposing device of the image forming apparatus 1.

The image forming apparatus 1 includes a controller 81 which controls various units as a whole, an image processing unit 82 which performs the predetermined image process desired by a user, and an image position calculating unit 83 which calculates the position of an toner image on the transfer belt 11.

Here, four colored toner images are formed on different photoconductors 10 and are transferred onto a single transfer belt 11 in turn. Accordingly, the image positions (registrations) of various colors are different due to an effect of part mounting positions. Accordingly, the image position calculating unit 83 calculates image position information for each color based on the position of the final toner image on the transfer belt 11, which is detected by the image position detecting sensors 14. The controller 81 calculates a target value to set, for example, a magnification using the image position information and provides the target value to the correction control part 20 as correction data. The optical scanning part 50 includes: a laser diode 51 as an exposure light source; a polygon motor 72 as a driving source which rotates a polygon mirror 59 (which will be described later), which is a rotating polyhedron; and a skew motor 75 which corrects a variation (skew) of the sheet 15 with respect to a rotation direction of the photoconductor 10, details of which will be described later. Here, for example, the correction control part 20 sets the number of steps of the skew motor 75 and controls a toner image of each color to match a target value by correcting a skew, or the like, with respect to the rotation direction of the photoconductor 10.

Figure 3:
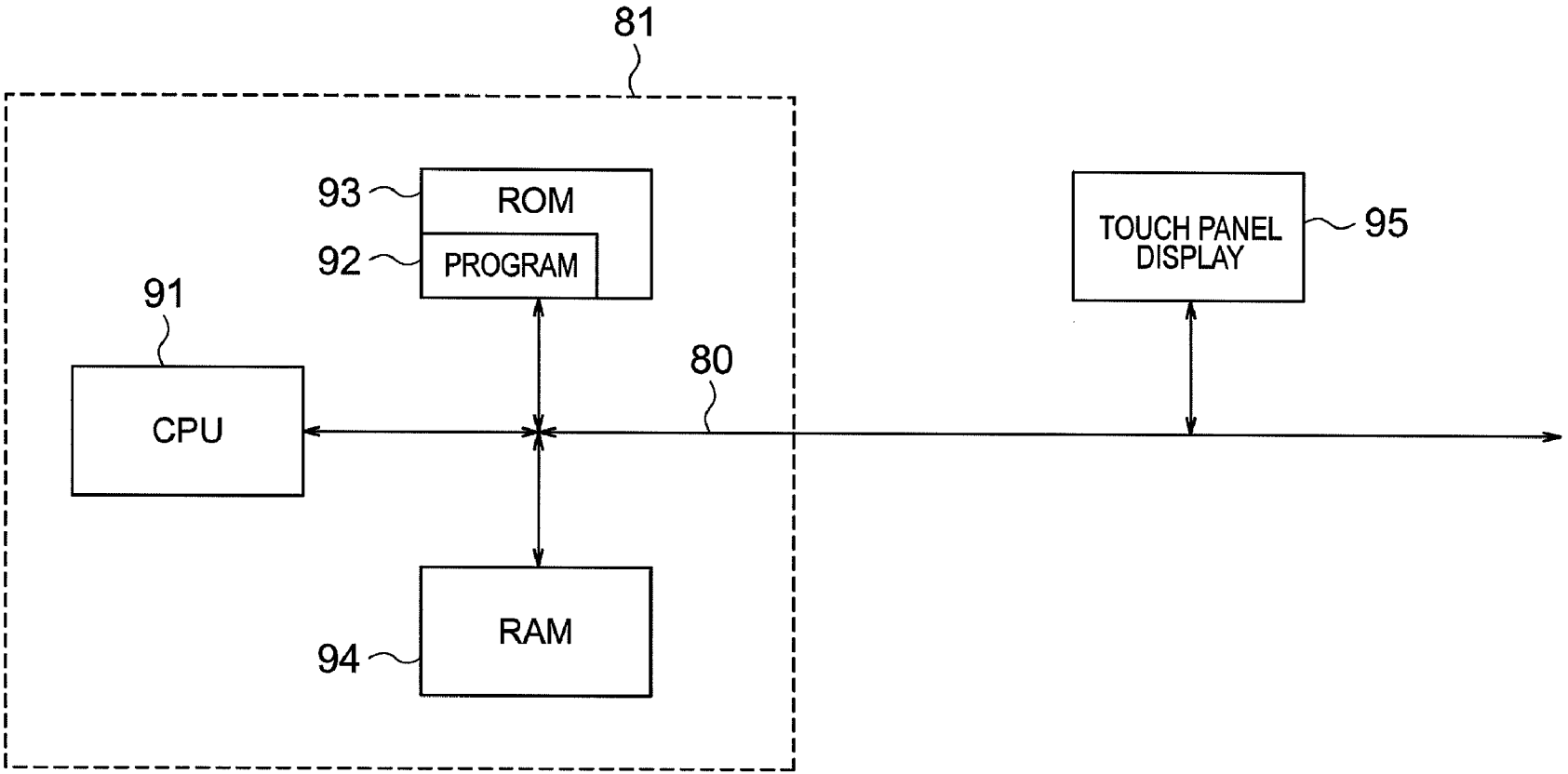
FIG. 3 is a block diagram showing an electrical connection of a controller of the image forming apparatus according to one exemplary embodiment of the present invention.

FIG. 3 is a block diagram showing electrical connection of the controller 81.

The controller 81 includes CPU 91 which controls various parts as a whole through various operations, a ROM 93 which stores various control programs 92 and various fixed data used by the CPU 91, and a RAM 94 as a work area of the CPU 91, all of which are interconnected by a bus 80. In addition to the various circuits shown in FIG. 2 being connected to the bus 80, a touch panel display 95, which receives inputs by various manipulations of the image forming apparatus 1 and displays various messages, is connected to the bus 80 via an interface (not shown). Although the control program 92 may be installed when the image forming apparatus 1 is manufactured, a control program 92 stored in a storing medium may be read later, or a control program 92 may be remotely downloaded via a predetermined communication means and set up in a nonvolatile memory or a magnetic storage.

Figure 4:
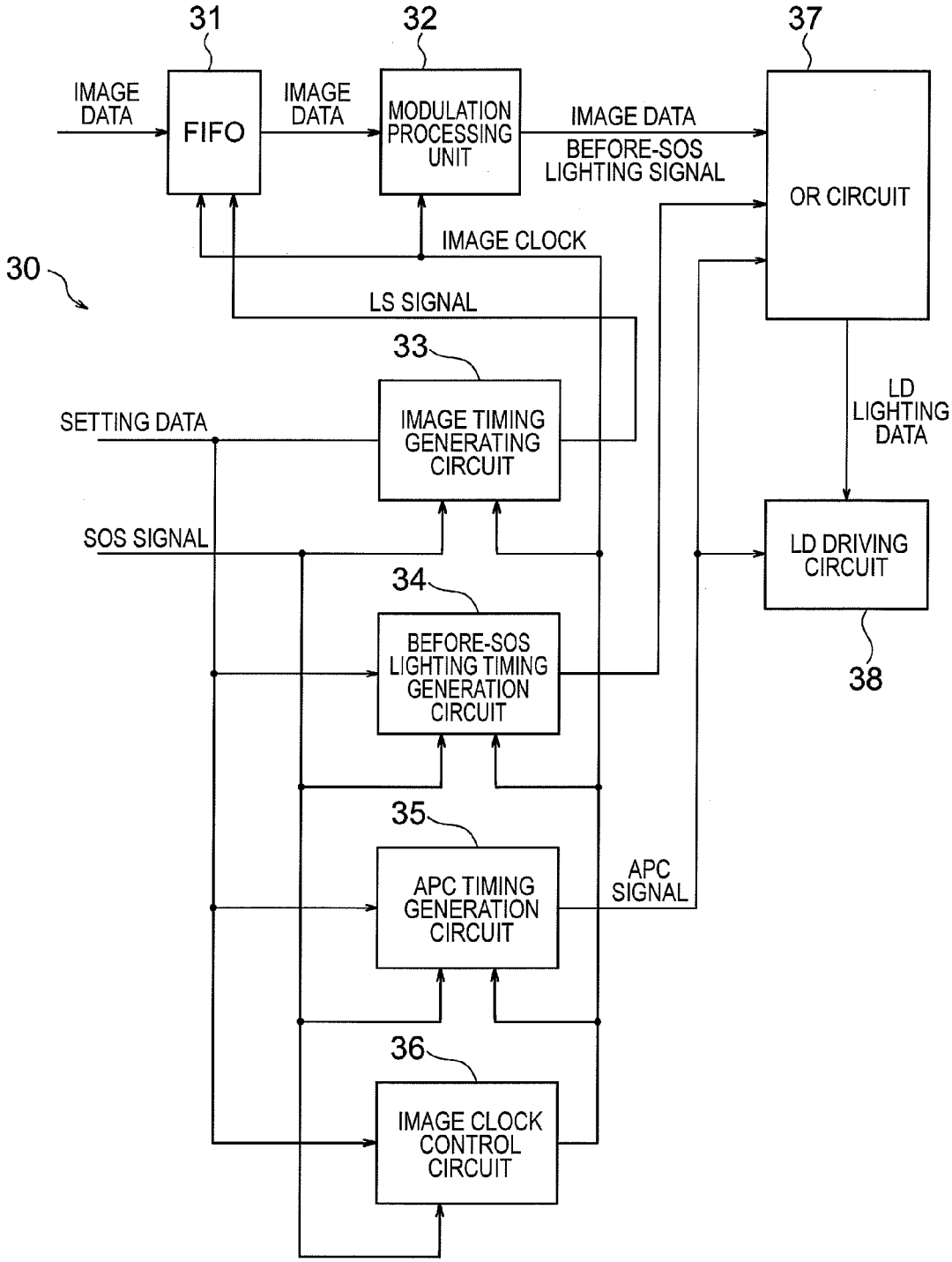
FIG. 4 is a block diagram showing a circuit configuration of a lighting control unit of the image forming apparatus according to one exemplary embodiment of the present invention.

FIG. 4 is a block diagram showing a circuit configuration of the lighting control part 30.

The lighting control part 30 includes a FIFO (First In First Out) memory 31, a modulation processor 32, an image timing generation circuit 33 which generates image clocks of predetermined frequencies, a before-SOS timing generation circuit 34 which generates a before-SOS lighting signal, an APC (Auto Power Control) timing generation circuit 35 which generates an APC signal, an image clock control circuit 36 which provides image clocks to various circuits, an OR circuit 37 which calculates a logical sum of various signals, and an LD (Laser Diode) driving circuit 38 which drives a laser diode 51 which will be described later.

Here, an "SOS signal" refers to a signal to estimate a timing of the beginning of a main scan of the laser beam. The SOS signal is generated by an SOS sensor 61 which will be described later. A "before-SOS lighting signal" refers to a signal to control the laser beam emitted from the laser diode 51 immediately before an output timing of the SOS signal to ensure that the SOS signal is output. An "APC signal" refers to a signal to instruct a control of the amount of the light of the laser beam emitted from the laser diode 51.

Image data from the image processing unit 82 are temporarily stored in the FIFO memory 31 in synchronization with an image clock from the image clock control circuit 36. The image timing generation circuit 33 is controlled by the controller 81 to count a predetermined number of image clocks from an input timing of the SOS signal and generate a read permission signal (LS signal) according to a position of a main scanning direction of an image. The image data stored in the FIFO memory 31 are read by the LS signal and provided to the modulation processor 32.

The modulation processor 32 performs a modulation process for multi-bit image data provided from the FIFO memory 31 and provides the modulated image data to the OR circuit 37.

The before-SOS timing generation circuit 34 counts the predetermined number of image clocks from the input timing of the SOS signal, generates the before-SOS lighting signal, and provides this before-SOS lighting signal to the OR circuit 37. In addition, the before-SOS timing generation circuit 34 counts the predetermined number of image clocks from the input timing of the SOS signal, generates the APC signal for controlling the amount of light emitted from the laser beam, and provides the APC signal to the OR circuit 37. In addition, in both of the before-SOS timing generation circuit 34 and the APC timing generation circuit 35, the number of counts of image clocks until each signal from the SOS signal is generated is set by the controller 81.

The image clock control circuit 36 generates image clocks of predetermined frequencies based on the SOS signal and sets data from the controller 81 and provides the generated image clocks to the FIFO memory 31, the modulation processor 32, the image timing generation circuit 33, the before-SOS timing generation circuit 34 and the APC timing generation circuit 35.

The OR circuit 37 calculates a logical sum of the various input signals. Upon receiving one of the image data, the before-SOS lighting signal and the APC signal are input, the OR circuit 37 provides a calculation result to the LD driving circuit 38 as LD lighting data. Accordingly, upon receiving the image data, the LD driving circuit 38 illuminates the laser diode 51 for scanning the photoconductor 10 with the laser beam. Upon receiving the before-SOS lighting signal, the LD driving circuit 38 forces the laser diode 51 to be illuminated immediately before an output timing of the SOS signal. Upon receiving the APC signal, the LD driving circuit 38 forces the laser diode to be illuminated for controlling the amount of light emitted from the laser beam. In addition, if the laser diode has plural of emission points, plural of lighting control units 30 corresponding to plural of emission points may be provided.

Figure 5:
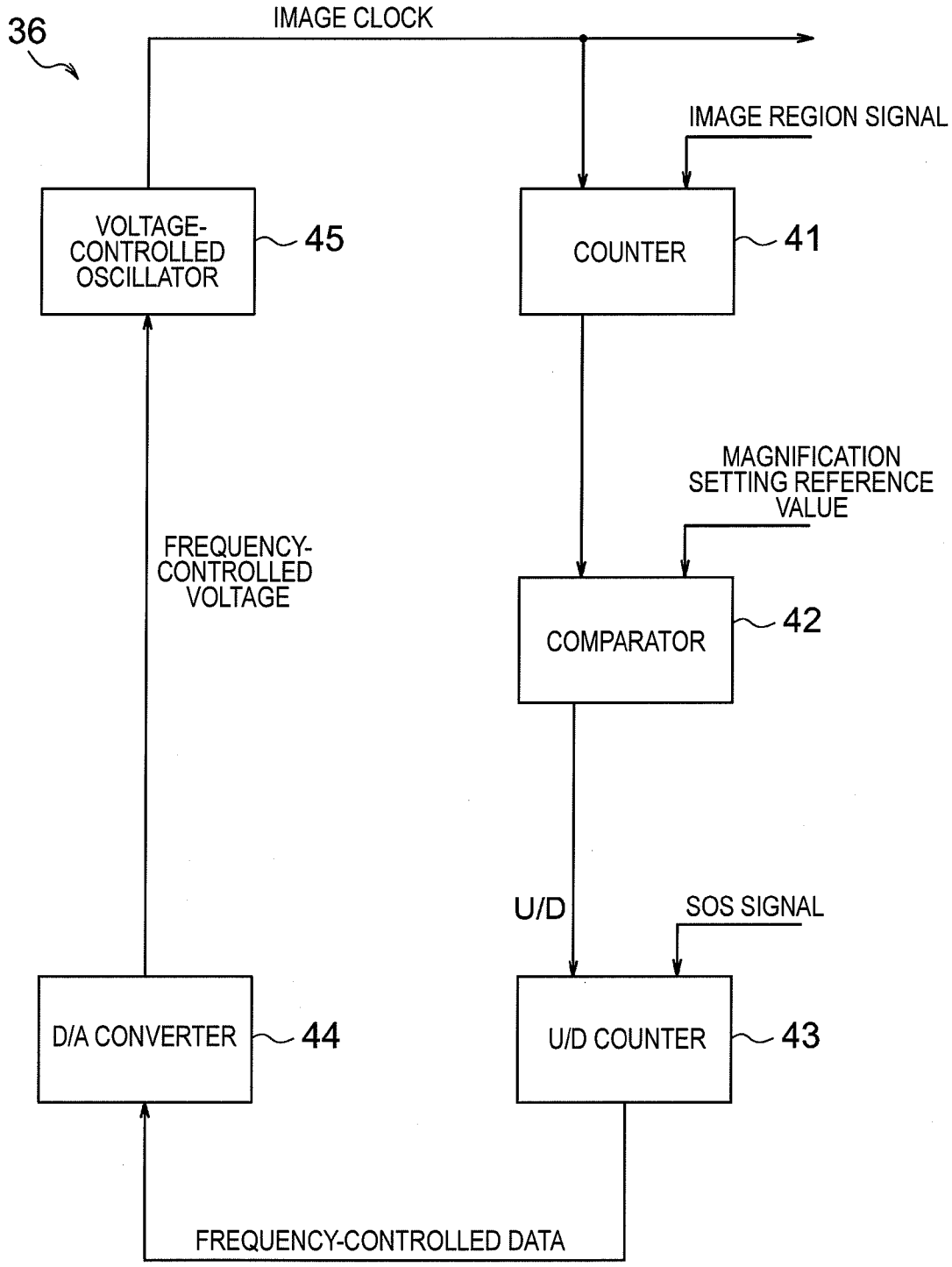
FIG. 5 is a circuit diagram of an image clock control circuit of the image forming apparatus according to one exemplary embodiment of the present invention.

FIG. 5 is a circuit diagram of the image clock control circuit 36.

That is, the image clock control circuit 36 includes a counter 41 which counts image clocks, a comparator 42 which compares a counter number with a magnification setting reference value, an up/down (U/D) counter 43 which counts up or down, a digital/analog (D/A) converter 44 which converts frequency-controlled data into an analog signal, and a voltage-controlled oscillator 45 which generates image clocks based on a frequency-controlled voltage.

The counter 41 counts the image clocks generated by the voltage-controlled oscillator 45 in a period of time (LS signal output period of time) corresponding to an image region to which an image region signal is provided.

The comparator 42 compares a count value counted by the counter 41 with the magnification setting reference value. The comparator 42 generates an UP signal instructing a clock frequency to be increased if the count value is smaller than the magnification setting reference value and generates a DOWN signal instructing a clock frequency to be decreased if the count value is larger than the magnification setting reference value. The magnification setting reference value is set by the controller 81.

The U/D counter 43 counts up upon receiving the UP signal at the input timing of the SOS signal and counts down upon receiving the DOWN signal at the input timing. That is, this count result indicates a degree of increase or decrease in the frequencies of the image clocks. In addition, the U/D counter 43 provides this count result to the D/A converter 44 as frequency-controlled data.

The D/A converter 44 converts the frequency-controlled data into an analog signal and provides a frequency-controlled voltage to the voltage-controlled oscillator 45. The voltage-controlled oscillator 45 generates the image clocks based on this frequency-controlled voltage and provides these image clocks to the above-mentioned FIFO memory 31, the modulation processor 32, the counter 41 and so on.

By repeating such a closed loop control, a magnification in the main scanning direction of a toner image of each color reaches the magnification setting reference value. This allows the image clocks to be controlled with a predetermined frequency defined by a target value. Accordingly, output timings of the before-SOS lighting signal and the APC signal are set to be predetermined timings. As a result, the laser diode 51 can be illuminated at a correct timing.

Figure 6:
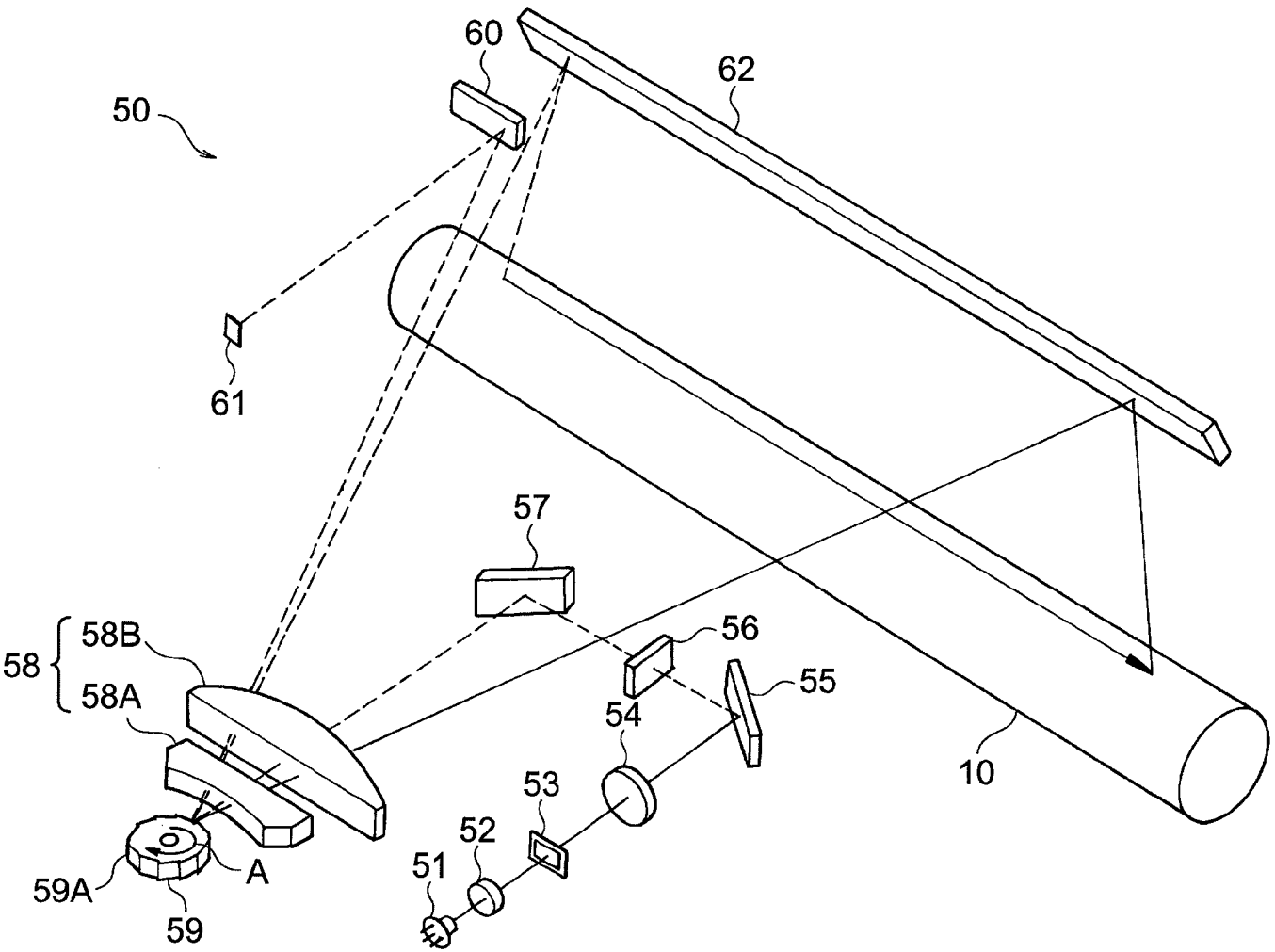
FIG. 6 is a view for explaining an optical system of an optical scanning unit of the image forming apparatus according to one exemplary embodiment of the present invention.

FIG. 6 is a view for explaining an optical system of the optical scanning part 50.

The optical scanning part 50 includes the laser diode 51 which emits the laser beam, a collimator lens 52 which converts the laser beam into parallel light, a slit 53 which shapes a wavelength of the laser beam, an expander lens 54 which expands an amplitude of the laser beam, and a reflective mirror 55 which reflects the laser beam to a predetermined direction.

The laser diode 51 may have either a single emission point or plural of emission points. The laser beam emitted from the laser beam 51 is converted into the parallel light by the collimator lens 52, shaped by the slit 53, and then its amplitude is expanded by the expander lens 54. In addition, the reflective mirror 55 changes the predetermined propagating direction of the laser beam.

In addition, the image forming apparatus includes the reflective mirror 55, a reflective mirror 57 which reflects the laser beam from a cylinder lens 56 in a predetermined direction, an fθ lens 58 which makes a scanning speed of the laser beam constant, and a polygon mirror 59 which scans the photoconductor 10 with the laser beam.

The fθ lens 58 is composed of a first lens 58A and a second lens 58B and causes the entire range from one end of the photoconductor 10 to the other end to be scanned by the laser beam at a constant speed.

The polygon mirror 59 is constituted by a regular polygon having plural of reflective surfaces 59A formed on its sides and is rotated at a high speed in an arrow A direction with its center of surfaces facing each other with side interposed therebetween as a rotation axis.

With this configuration, the laser beam reaching the polygon mirror 59 from the reflective mirror 57 via the fθ lens 58 is deflected at its incident angle into the polygon mirror 59 and is continuously changed. In the case of an over field type, the width of the laser beam incident into the polygon mirror 59 in the scanning direction becomes sufficiently larger than the size of the reflective surfaces 59A of the polygon mirror 59. Accordingly, the polygon mirror 59 cuts off a portion of the laser beam and scans the photoconductor 10 with the cut laser beam.

In addition, the image forming apparatus 1 further includes a reflective mirror 60 which reflects the laser beam to a predetermined direction, an SOS sensor 61 which receives the laser beam reflected by the reflective mirror 60 and outputs an SOS signal upon receiving the laser beam, and a cylindrical mirror 62 which reflects the laser beam to the photoconductor 10.

The reflective mirror 60 is arranged at a position substantially equal to a main scanning start position on the cylindrical mirror 62 and reflects the laser beam to the SOS sensor 61 immediately before the main scanning starts. Upon detecting the laser beam from the reflective mirror 60, the SOS sensor 61 generates the SOS signal. That is, when the SOS sensor 61 receives the laser beam from the polygon mirror 59 via the reflective mirror 60, the SOS signal is generated every one scan.

The cylindrical mirror 62 focuses the laser beam from the polygon mirror 59 onto the photoconductor 10. In addition, similarly, the cylindrical mirror 62 focuses the laser beam on the photoconductor 10 in a sub scanning direction.

In the above-configured image forming apparatus, the width of an image region with respect to a scannable width, that is, an effective scan rate, can be sufficiently increased in order to allow the polygon mirror 59 to cut off a portion of the laser beam and scan the photoconductor 10 with the cut laser beam.

Figure 7:
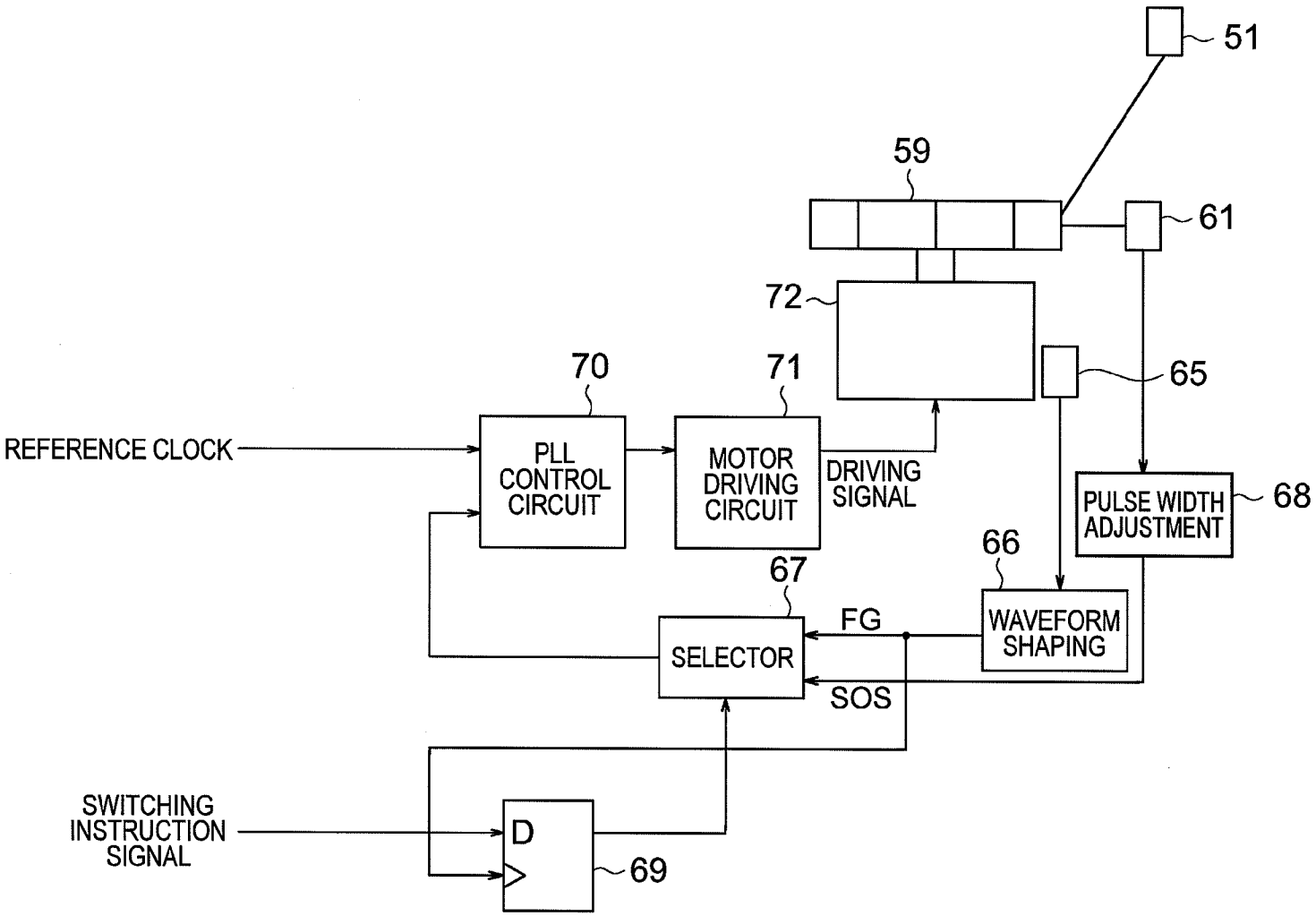
FIG. 7 is a circuit diagram of a control system of a polygon motor of the image forming apparatus according to one exemplary embodiment of the present invention.

FIG. 7 is a circuit diagram of a control system of the polygon motor 72.

This control system includes a FG (Frequency Generator) sensor 65 which detects the number of rotations of the polygon motor 72, which will be described later, a waveform shaping circuit 66 which shapes a waveform of an FG signal which is an output signal of the FG sensor 65, a selector 67 which selects one of the FG signal and the SOS signal, a pulse width adjustment circuit 68 which adjusts a pulse width of the SOS signal to, for example, a duty cycle of 50%, a D flip-flop 69 which instructs the selector 67 to switch between selections, a PLL (Phase-Locked Loop) control circuit 70 which PLL-controls an input signal based on a reference clock, a motor driving circuit 71 which drives the polygon motor 72, and the polygon motor 72 which rotates the polygon mirror 59.

The FG sensor 65 detects the number of rotations of the polygon motor 72, generates a rotation frequency signal (FG signal) based on the detected number of rotations, and provides the generated FG signal to the selector 67 and the D flip-flop 69 via the waveform shaping circuit 66. The pulse width adjustment circuit 68 adjusts the pulse width of the SOS signal detected by the SOS sensor 61 and provides the adjusted pulse width to the selector 67.

The D flip-flop 69 has a clock terminal input with an FG signal and a D terminal input with a switching instruction signal from the controller 81. The D flip-flop 69 latches the switching instruction signal to output a switching signal which is a output result to be provided to the selector 67.

The selector 67 selects the FG signal if the switching signal from the D flip-flop 69 has an L level and selects the SOS signal if the switching signal has an H level. The selector 67 provides the selected signals to the PLL control circuit 70.

The PLL control circuit 70 PLL-controls the FG signal or the SOS signal output from the selector 67 in synchronization with a reference clock and provides the PLL-controlled FG or SOS signal to the motor driving circuit 71.

The motor driving circuit 71 generates a driving signal based on the signal from the PLL control circuit 70 and provides the generated driving signal to the polygon motor 72. Based on the driving signal, the polygon motor 72 rotates the polygon mirror 59 so that the photoconductor 10 can be scanned with the laser beam.

Here, in starting the polygon motor 72, the selector 67 is set to select the FG signal in synchronization with an output of the FG sensor 65. That is, in starting the polygon motor 72, the polygon motor 72 is driven for a specified number of rotations by an internal control. Thereafter, the FG signal is switched-over to the SOS signal.

Figure 8:
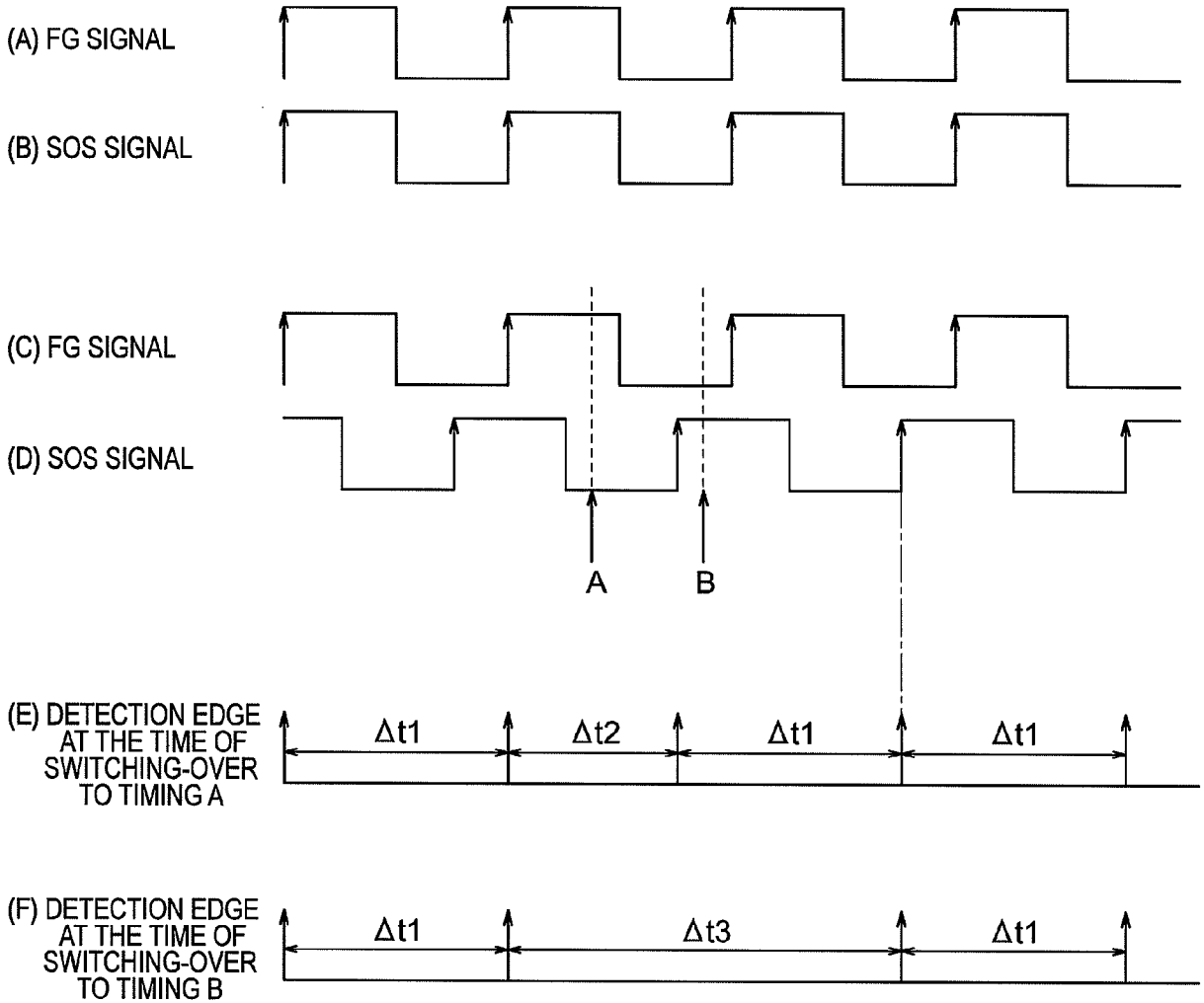
FIG. 8 is a timing chart of various signals of the image forming apparatus according to one exemplary embodiment of the present invention.

FIGS. 8(A) and 8(B) show a timing chart at the time when a phase of the FG signal coincides with a phase of the SOS signal. The shown state is an ideal state where no rotational variation occurs even when the FG signal is switched over to the SOS signal at any timing by the selector 67. However, since a difference in phase between the FG signal and the SOS signal is fixed when the polygon mirror 59 is mounted on the polygon motor 72, usual assembly provides an extremely low possibility of phase coincidence. Although it is possible, in principle, to match a phase of the FS signal with a phase of the SOS signal in mounting the polygon mirror 59, it is impractical since it requires precise position determination and causes an increase in the number of assembly processes and the cost of the parts.

FIGS. 8(C) and 8(D) show an example of a phase relationship between the FG signal and the SOS signal when usual assembly is performed without any precise position determination. In a general image forming apparatus, for example, when the FG signal is switched over to the SOS signal at a timing A in the figures, an edge interval during which a rotation frequency signal is detected quickly becomes short as it is changed from Δt1 to Δt2, as shown in FIG. 8(E). When the edge interval becomes short, the controller 81 determines that the polygon motor 72 is rotating too fast and controls the rotation of the polygon motor 72 to slow down. That is, when the FG signal is switched over to the SOS signal during this period of time, since the rotation of the polygon motor 72 is slowed down, this period of time corresponds to a period of time when the polygon motor 72 is instructed to slow down.

When the FG signal is switched over to the SOS signal at a timing B in FIGS. 8(C) and 8(D), an edge interval during which a rotation frequency signal is detected becomes long in an instant where it is changed from Δt1 to Δt3, as shown in FIG. 8(F). In a general PLL control, when the edge interval of the rotation frequency signal becomes long, it is determined that the polygon motor 72 is rotating slowly and the rotation of the polygon motor 72 is controlled to speed up.

Accordingly, when the FG signal is switched over to the SOS signal from immediately after an edge for detecting the rotation frequency of the FG signal is detected to immediately before an edge for detecting a rotation frequency signal of the SOS signal is detected, the polygon motor 72 cannot speed up so as to run recklessly, irrespective of a phase relationship between these signals. Therefore, the image forming apparatus 1 switches the FG signal to the SOS signal within this period of time.

Figure 9:
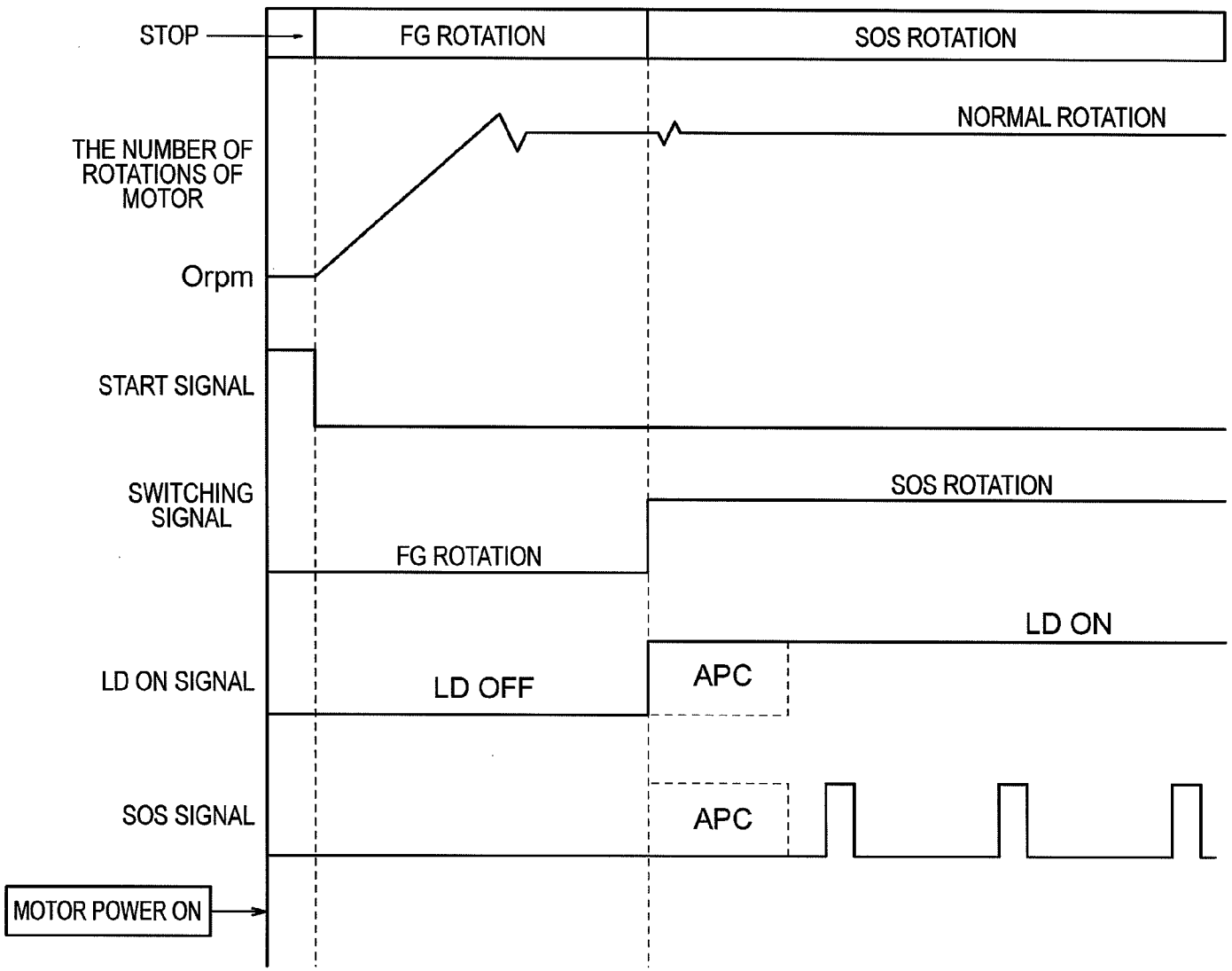
FIG. 9 is a timing chart showing a state at the start of the rotation of the polygon motor of the image forming apparatus according to one exemplary embodiment of the present invention.

FIG. 9 is a timing chart showing a state at the start of the rotation of the polygon motor 72.

As shown in FIG. 9, the polygon motor 72 is necessarily rotated using the FG signal at the start of the rotation of the polygon motor 72. If the polygon motor 72 is to be rotated using the SOS signal at the start of the rotation of the polygon motor 72, the laser diode 51 has to be illuminated while changing a timing of a before-SOS lighting signal in synchronization with speed-up of the polygon motor 72. However, in order to change the timing of the before-SOS lighting signal in synchronization with the start of the rotation of the polygon motor 72, the circuit configuration and control content becomes complicated and a rising characteristic of the respective polygon motor 72 is varied due to its manufacturing variations. Therefore, it is impractical to rotate the polygon motor 72 using the SOS signal at the start of the rotation of the polygon motor 72. In addition, although there is a method of continuously lighting the laser beam at the start of the rotation of the polygon motor 72, since this method exposes the photoconductor 10 by continuous lighting, the photoconductor 10 is likely to deteriorate. Moreover, as the accumulated lighting time of the laser beam becomes long, the durability of the laser diode 51 may deteriorate. Accordingly, by controlling the rotation of the polygon motor 72 using the FG signal at the start of the rotation of the polygon motor 72 and switching over from the FG signal to the SOS signal after the number of rotations of the polygon motor 72 is sufficiently stable, it is possible to prevent the photoconductor 10 from deteriorating and increase the durability of the laser diode 51.

Figure 10:
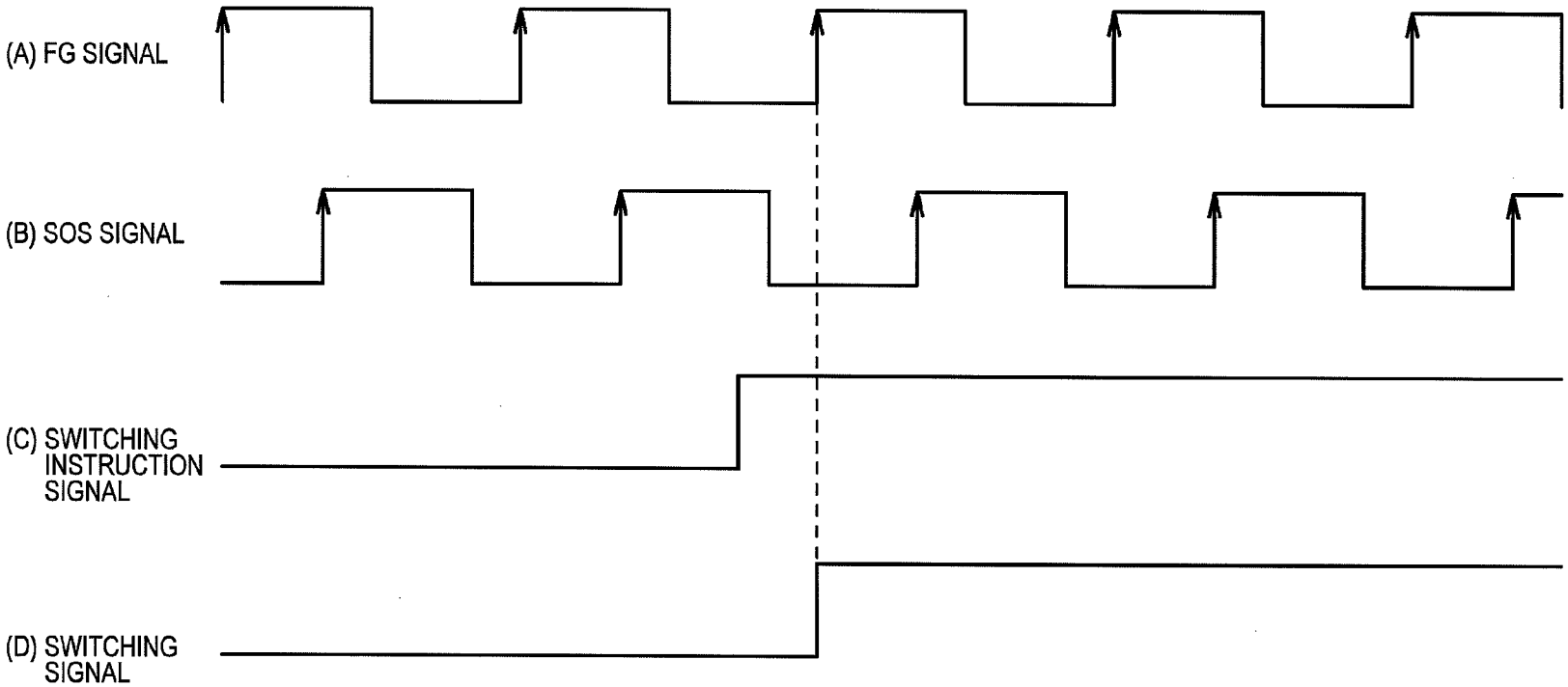
FIG. 10 is a timing chart of various signals of the image forming apparatus according to one exemplary embodiment of the present invention.

More specifically, the polygon motor 72 is rotating with the specified number of rotations after its start. At this time, the FG signal and the SOS signal are as shown in FIGS. 10(A) and 10(B), respectively, and have a phase difference occurring therebetween. Upon receiving an L level switching instruction signal as shown in FIG. 10(C), the D flip-flop 69 outputs an L level switching signal as shown in FIG. 10(D). Accordingly, the selector 67 selects the FG signal.

Upon receiving an H level switching instruction signal from the controller 81, the D flip-flop 69 latches an H level switching signal at a rising edge of the next FG signal and provides the H level switching signal to the selector 67. Upon receiving the H level switching signal, the selector 67 selects and outputs the SOS signal. That is, since a switching signal is switched over from an L level to an H level immediately after a rising edge of the FG signal, it is possible to prevent the rotation of the polygon motor 72 from speeding up irrespective of a phase relationship between the FG signal and the SOS signal.

As described above, the image forming apparatus 1 switches over from the FG signal to the SOS signal immediately after the edge of the FG signal is detected. That is, since the image forming apparatus 1 latches the switching instruction signal at a rising edge of the FG signal in order to perform such signal switching, it is possible to prevent a pulse interval (edge interval) between signals, used for driving the polygon motor 72, from being widened. As a result, it is possible to prevent the polygon motor 72 from running recklessly and provide correct scanning with the laser beam.

In this manner, in the image forming apparatus 1, the polygon motor 72 is controlled based on the FG signal at its start, and thereafter is controlled based on the SOS signal when a latent image is formed on the photoconductor 10. However, even if the FG signal is controlled to be switched over to the SOS signal, it does not ensure that the polygon motor 72 is necessarily controlled based on the SOS signal. There may be a case where the polygon motor 72 can not be controlled based on the SOS signal due to disconnections of the SOS sensor 61, a failure of the PLL control circuit 70, or the like. In this case, if a color image is formed with no measure, beginning positions (registrations) of latent images of various colors are misaligned between the image forming parts 2 of various colors of yellow, magenta, cyan and black, which results in deterioration of image linearity.

To overcome this problem, the image forming apparatus 1 is provided with means for determining whether or not the polygon motor 72 can be controlled based on the SOS signal when the control of the polygon motor 72 based on the FG signal is switched over to the control of the polygon motor 72 based on the SOS signal. Hereinafter, these means will be described in detail.

In order to prevent beginning positions of latent images of various colors from being misaligned between the image forming parts 2 of various colors, the image forming parts 2 of various colors have to have a preset phase relationship between SOS signals. Hereinafter, as one example, a case where phases of SOS signals between the image forming parts 2 of various colors were made equal to each other will be described. When phases of SOS signals between the image forming parts 2 of various colors are made equal to each other, it becomes easier to control the beginning positions of latent images in a sub scanning direction. However, the present invention is not limited thereto but the image forming parts 2 of various colors may have a preset phase difference between SOS signals.

Figure 11:
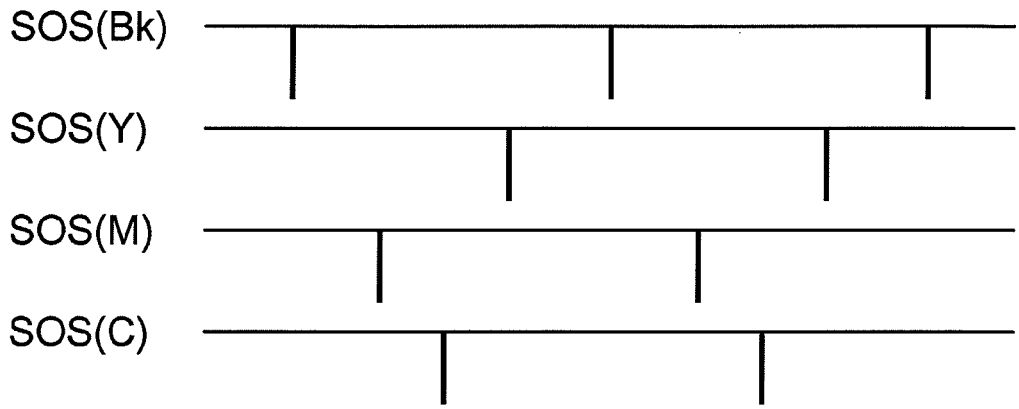
FIG. 11 is a timing chart of SOS signals of various color image forming parts of the image forming apparatus according to one exemplary embodiment of the present invention.
Figure 12:
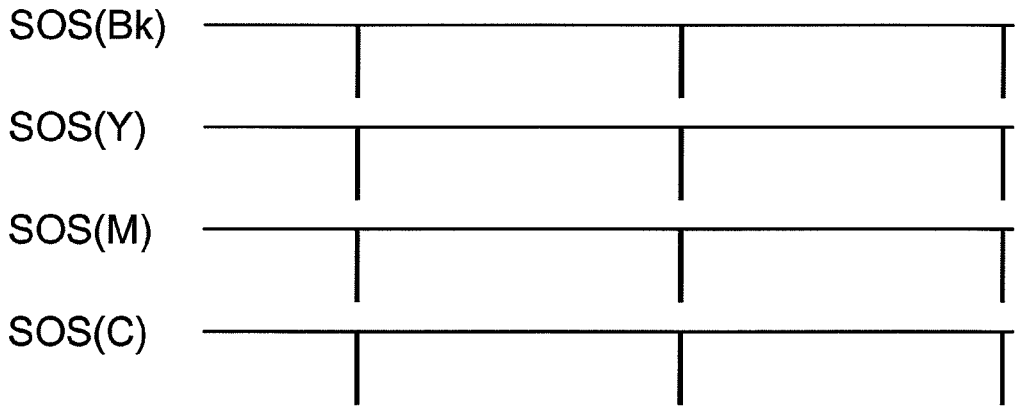
FIG. 12 is a timing chart of SOS signals of various color image forming parts of the image forming apparatus according to one exemplary embodiment of the present invention.

FIGS. 11 and 12 are timing charts of SOS signals of various color image forming parts 2 in the above cases.

In these figures, SOS(Bk), SOS(Y), SOS(M) and SOS(C) represent an SOS signal of the image forming part 2Bk, an SOS signal of the image forming part 2Y, an SOS signal of the image forming part 2M and an SOS signal of the image forming part 2C, respectively. FIG. 11 shows an example of a timing of each SOS signal when the polygon motor 72 is controlled based on a FG signal and FIG. 12 shows an ideal example of a timing of each SOS signal when the polygon motor 72 is controlled based on an SOS signal. In other words, in the example of FIG. 11, since the polygon motor 72 is controlled based on the FG signal, phases of SOS signals are nonuniform, while, in the example of FIG. 12, since the polygon motor 72 is normally controlled based on the SOS signals, the phases of the SOS signal are in accordance. Accordingly, in the case of FIG. 12, beginning positions of latent images of various colors are in accordance between the image forming parts 2 of various colors, which results in good image linearity.

Figure 13:
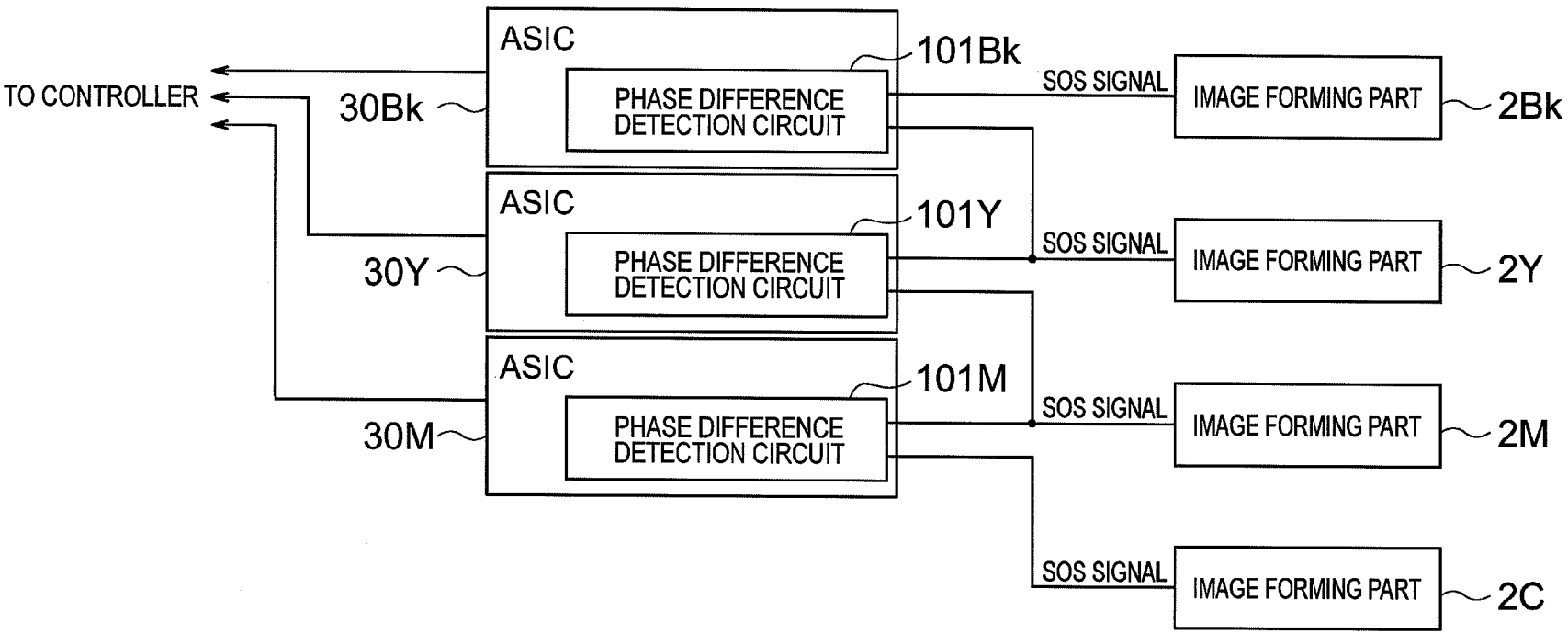
FIG. 13 is a block diagram showing a circuit configuration to detect whether or not the polygon motor is switched over to a control based on an SOS signal when control of the polygon motor based on the SOS signal of the image forming apparatus according to one exemplary embodiment of the present invention is started.

FIG. 13 is a block diagram showing a circuit configuration to detect whether or not the polygon motor is switched over to the procedure based on the SOS signal when the procedure of the polygon motor 72 based on the SOS signal is started.

For example, each lighting control part 30 is provided with a phase difference detection circuit 101. Each phase difference detection circuit 101 receives an SOS signal of the image forming part 2 corresponding to the lighting control part 20 and an SOS signal of another image forming part 2 adjacent to the image forming part 2 and detects whether or not a phase difference between both SOS signals is a preset phase difference (here both phases are in accordance). For example, the phase difference detection circuit 101 of the image forming part 2Bk receives an SOS signal of the image forming part 2Bk and an SOS signal of the image forming part 2Y and detects whether or not a phase difference between the SOS signals is a preset phase difference. A result of the detection by the phase difference detection circuit 101 of whether or not the phase difference is the preset phase difference is output to the controller 81.

Figure 14:
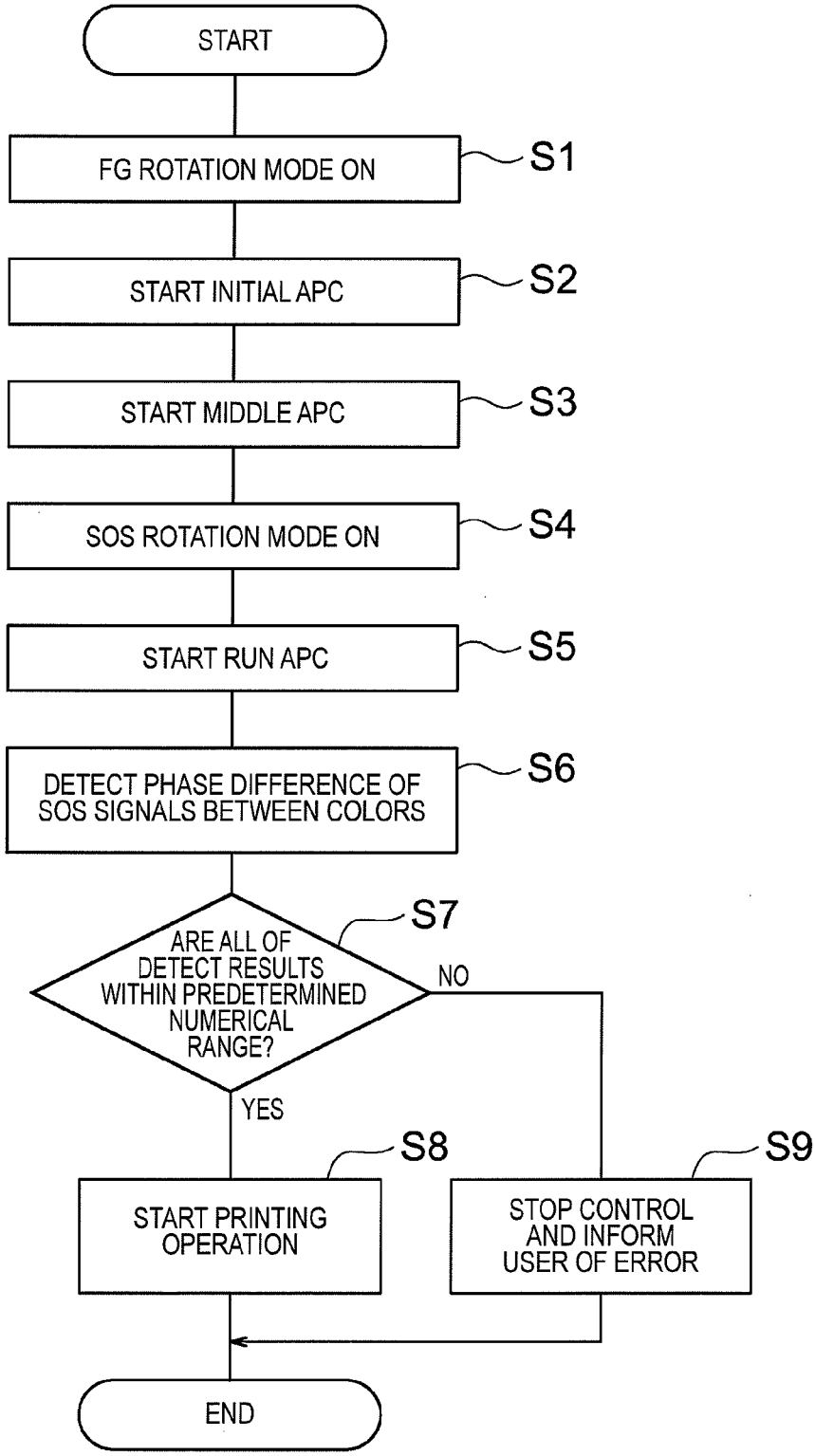
FIG. 14 is a flow chart of a procedure performed by a controller using the circuit of FIG. 13 of the image forming apparatus according to one exemplary embodiment of the present invention.

FIG. 14 is a flow chart of a procedure performed by the controller 81 using the circuit of FIG. 13.

First, the controller 81 turns ON an "FG rotation mode" to control the polygon motor 72 based on the FG signal at the start of the rotation of the polygon mirror 59 (Step S1). That is, if the polygon mirror 59 begins to rotate and an SOS signal does not begin to be input, since the polygon motor 72 can not transition to an "SOS rotation mode" to control the rotation of the polygon motor 72 based on the SOS signal, the FG rotation mode is necessarily turned ON at the start of the rotation of the polygon mirror 59. Accordingly, the control of the rotation of the polygon motor 72 based on the FG signal starts. Then, an "initial APC" to control the amount of light beam emitted from the laser diode 51 to be a start initial light amount (Step S2) is started by the APC signal.

Then, the SOS signal begins to be input and a "MIDDLE APC" starts which controls the light amount of the laser beam emitted from the laser diode 51 such that the laser beam does not deviate from the SOS sensor 61 (Step S3). In addition, the initial APC, MIDDLE APC and the like are simultaneously performed in the image forming parts 2 for all of the colors. In addition, since the SOS signal begins to be input, the SOS rotation mode is turned ON (Step S4). Next, a "Run APC" starts which controls the amount of light of the laser beam emitted from the laser diode 51 when a latent image is formed (Step S5).

Next, each phase difference detection circuit 101 detects a phase difference of the SOS signals between the image forming parts 2 of various colors (Step S6). Accordingly, a phase difference between the SOS signal of the image forming part 2Bk and the SOS signal of the image forming part 2Y, a phase difference between the SOS signal of the image forming part 2Y and the SOS signal of the image forming part 2M and a phase difference between the SOS signal of the image forming part 2M and the SOS signal of the image forming part 2C are detected. Then, it is determined whether or not all the detected phase differences are within a preset numerical range (here about 0° or 360°) (Step S7).

If all the detected phase differences are within the preset numerical range (Y in Step S7), it means that the SOS rotation mode in each image forming part 2 is normally operated, the image forming apparatus 1 starts a printing operation (Step S8). If this is not the case (N in Step S7), since it may mean that the SOS rotation mode in any image forming part 2 is not normally operated, a printing operation of the image forming apparatus 1 is controlled to be stopped and a message is displayed on a touch panel display 95 to inform a user of an error (Step S9).

Figure 15:
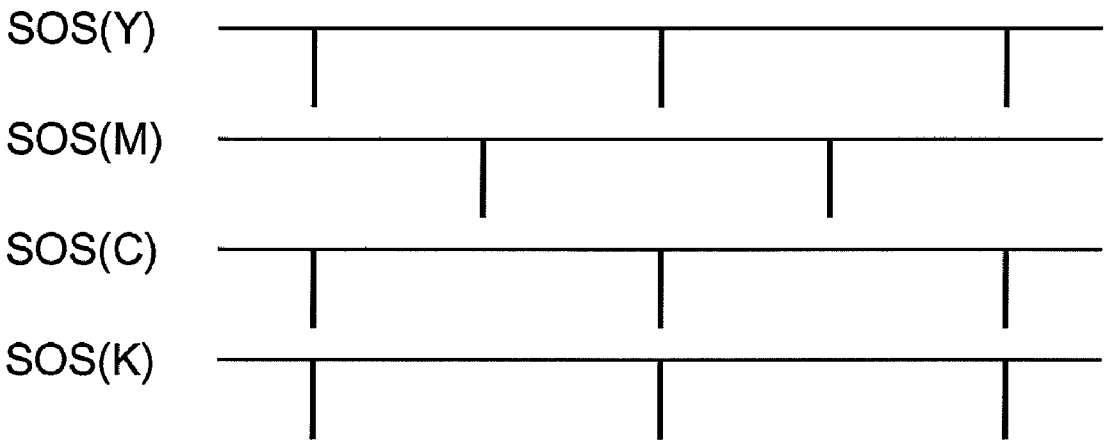
FIG. 15 is a timing chart of various SOS signals when an SOS rotation mode is not normally operated in one image forming part of the image forming apparatus according to one exemplary embodiment of the present invention.

FIG. 15 is a timing chart of various SOS signals when the SOS rotation mode is not normally operated in any image forming part 2.

Although a timing of each SOS signal in the SOS rotation mode is as shown in FIG. 12 when the SOS rotation mode in each image forming part 2 is normally operated, a timing of each SOS signal in the SOS rotation mode is as shown in FIG. 15 if the SOS rotation mode is not normally operated. In this example, a timing of the SOS signal of the image forming part 2Y exhibits an abnormality.

Figure 16:
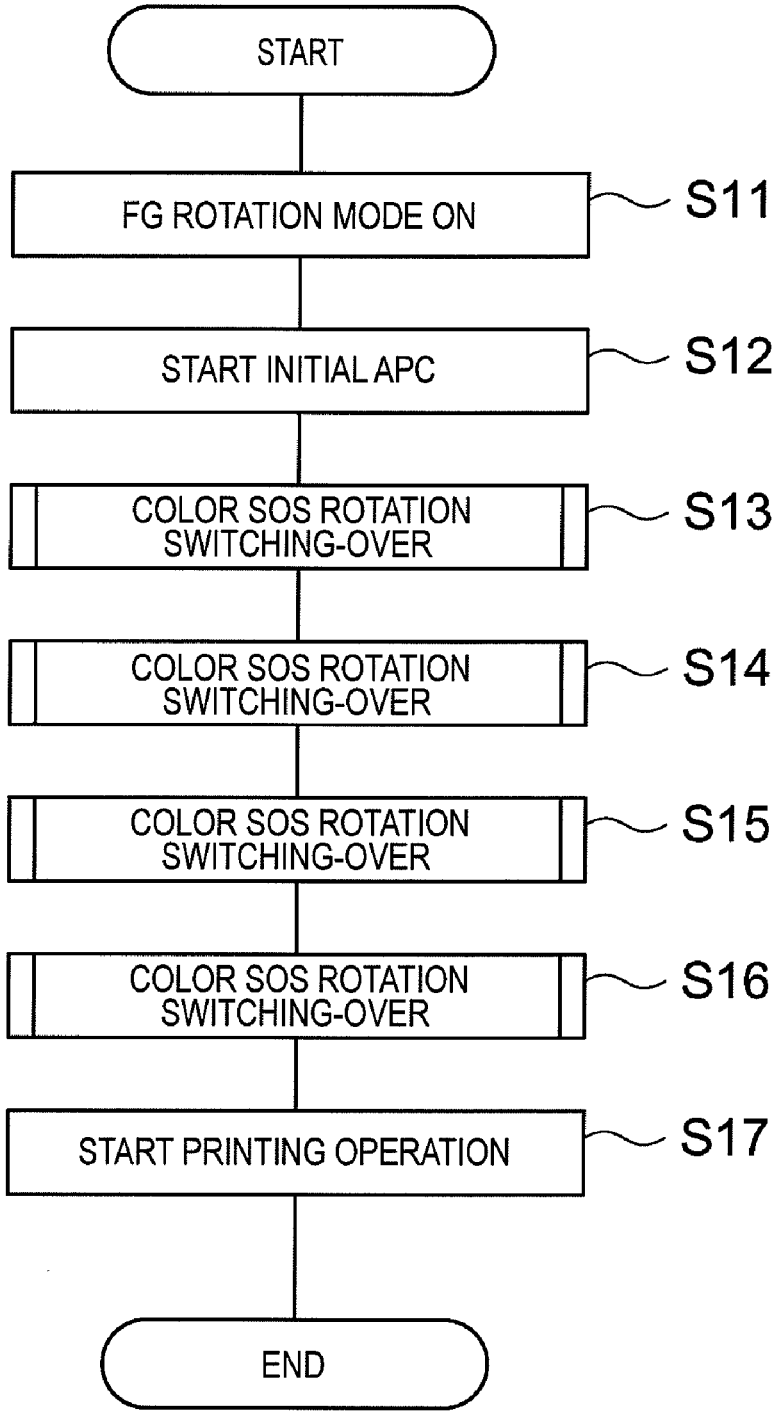
FIG. 16 is a flow chart of another exemplary procedure performed by a controller using the circuit of FIG. 13 of the image forming apparatus according to one exemplary embodiment of the present invention.

FIG. 16 is a flow chart of another exemplary procedure performed by the controller 81 using the circuit of FIG. 13.

First, the controller 81 turns ON the FG rotation mode at the start of rotation of the polygon mirror 59 (Step S11). Then, a rotation control of the polygon motor 72 based on the FG signal starts. Next, an initial APC starts (Step S12). Then, the polygon mirror 59 begins to rotate and the SOS signal begins to be input. Then, the control transitions to a Bk (black) color SOS rotation switching-over process (Step S13), transitions to a Y (yellow) color SOS rotation switching-over process (Step S14), transitions to a M (magenta) color SOS rotation switching-over process (Step S15), and transitions to a C (cyan) color SOS rotation switching-over process (Step S16), which will be described later. When all these switching-over processes are performed, the image forming apparatus 1 starts a printing operation (Step S17).

Figure 17:
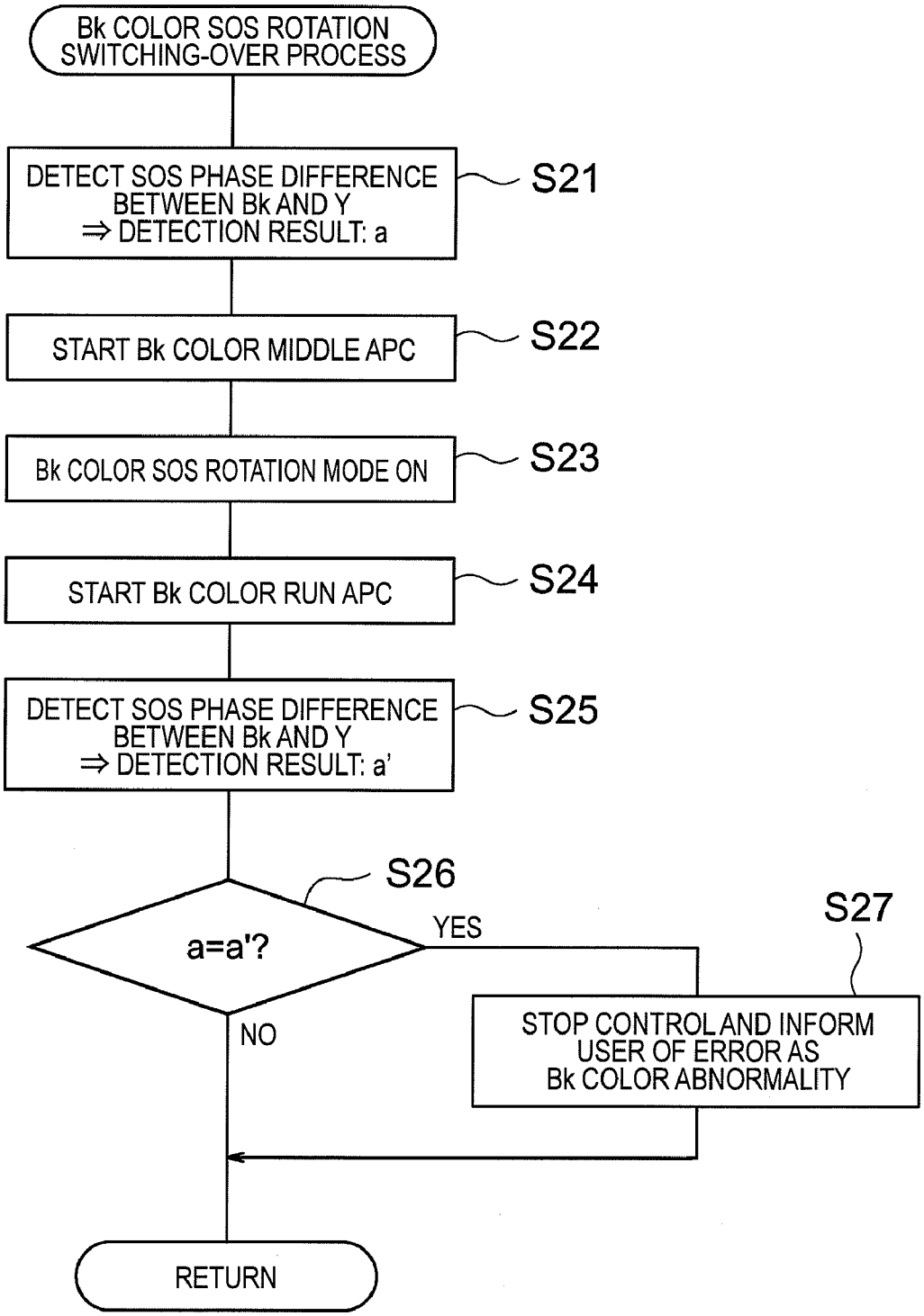
FIG. 17 is a flow chart of a Bk color SOS rotation switching-over process of the image forming apparatus according to one exemplary embodiment of the present invention.

FIG. 17 is a flow chart of the Bk color SOS rotation switching-over process.

In this process, first, a phase difference detection circuit 101Bk detects a phase difference between an SOS signal of the image forming part 2Bk and an SOS signal of the adjacent image forming part 2Y and assumes a result of the detection as "a" (Step S21). Then, the MIDDLE APC starts for the image forming part 2Bk (Step S22), the SOS rotation mode is turned ON for the image forming part 2Bk (Step S23), and the Run APC starts for the image forming part 2Bk (Step S24). Next, the phase difference detection circuit 101Bk again detects the phase difference between the SOS signal of the image forming part 2Bk and the SOS signal of the adjacent image forming part 2Y and assumes a result of the detection as "a'" (Step S25).

Next, it is determined whether or not the detection result a and the detection result a' are equal to each other (Step S26). If they are not equal (N in Step S26), the procedure proceeds to the next process. If they are equal (Y in Step S26), it may mean that the SOS signal in the image forming part 2Bk has an abnormality, and accordingly a printing operation of the image forming apparatus 1 is controlled to be stopped and a message is displayed on the touch panel display 95 to inform a user of an error (Step S27). Since it can be seen from this error information that an exposing unit of the image forming part 2Bk has an abnormality, it is informed that there is abnormality in the exposing unit of the image forming part 2Bk.

Similar to the Bk color SOS switching-over process of FIG. 17, the processes performed in Steps S14, S15 and S16 are to determine whether or not there is an abnormality in the exposing units of the image forming parts 2 of corresponding colors (Therefore, a detailed explanation of which will not be repeated).

FIGS. 18 and 19 are timing charts for explaining the process of FIG. 17.

Figure 18A:
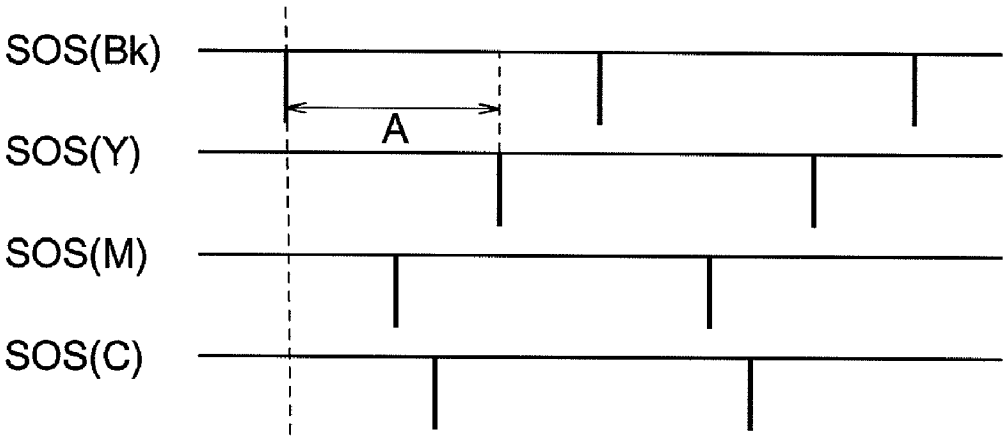
FIGS. 18A and 18B are timing charts for explaining the process of FIG. 17 of the image forming apparatus according to one exemplary embodiment of the present invention.
Figure 18B:
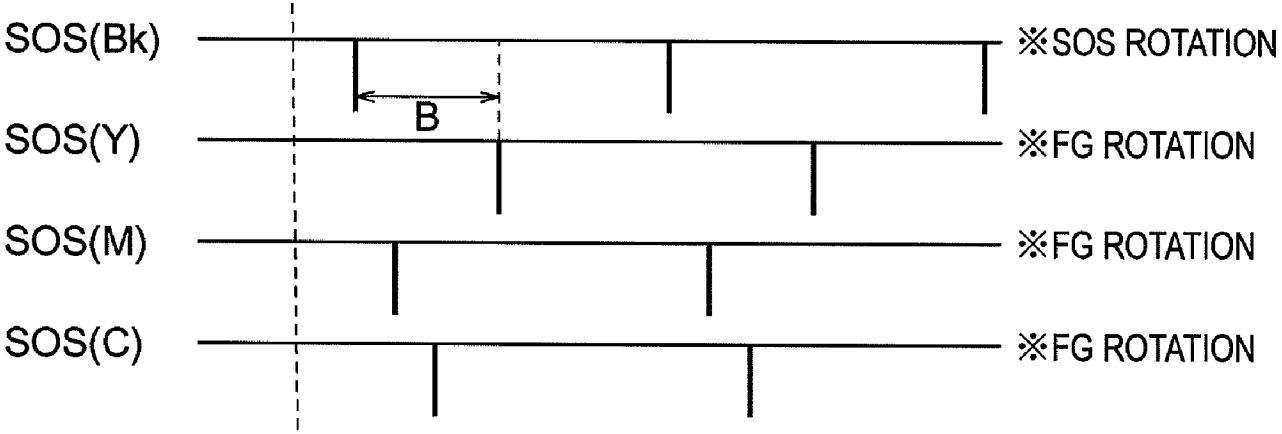

In FIG. 18, since a phase difference A between an SOS signal of the image forming part 2Bk and an SOS signal of the image forming part 2Y in the FG rotation mode as shown in FIG. 18(A) is different from a phase difference B between an SOS signal of the image forming part 2Bk in the SOS rotation mode and an SOS signal of the image forming part 2Y in the FG rotation mode, as shown in FIG. 18(B), it is determined that the SOS rotation mode switching-over is normally performed.

Figure 19A:
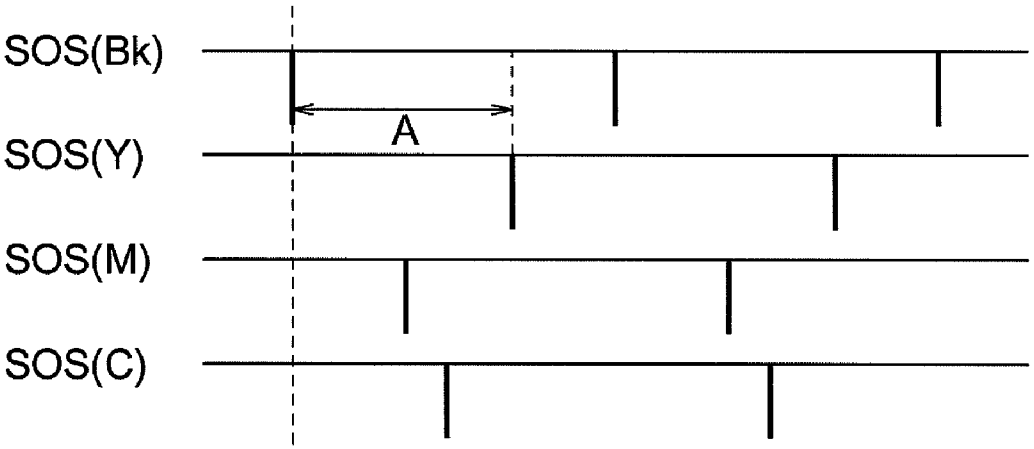
FIGS. 19A and 19B are timing charts for explaining the process of FIG. 17 of the image forming apparatus according to one exemplary embodiment of the present invention.
Figure 19B:
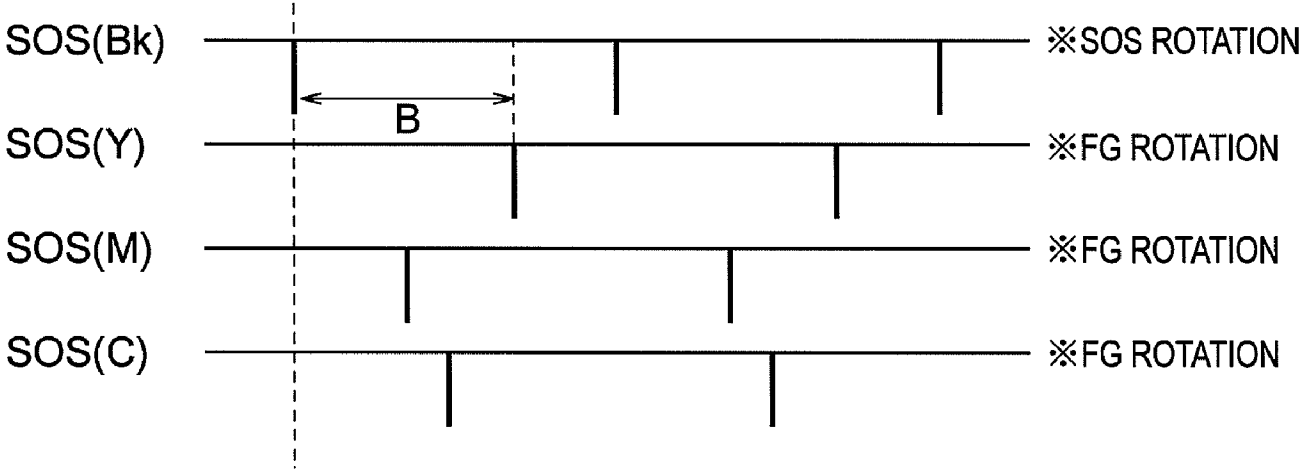

On the other hand, in FIG. 19, since a phase difference A between an SOS signal of the image forming part 2Bk and an SOS signal of the image forming part 2Y in the FG rotation mode, as shown in FIG. 19(A), is equal to a phase difference B between an SOS signal of the image forming part 2Bk in the SOS rotation mode and an SOS signal of the image forming part 2Y in the FG rotation mode, as shown in FIG. 19(B), it is determined that the SOS rotation mode switching-over is not normally performed.

For the process of FIG. 17, since there is a need to switch over individual image forming parts 2 to the SOS rotation mode in turn, it takes a long time to start a printing operation. Accordingly, processes of FIGS. 20 to 23 may be performed instead of the process of FIG. 17.

Figure 20:
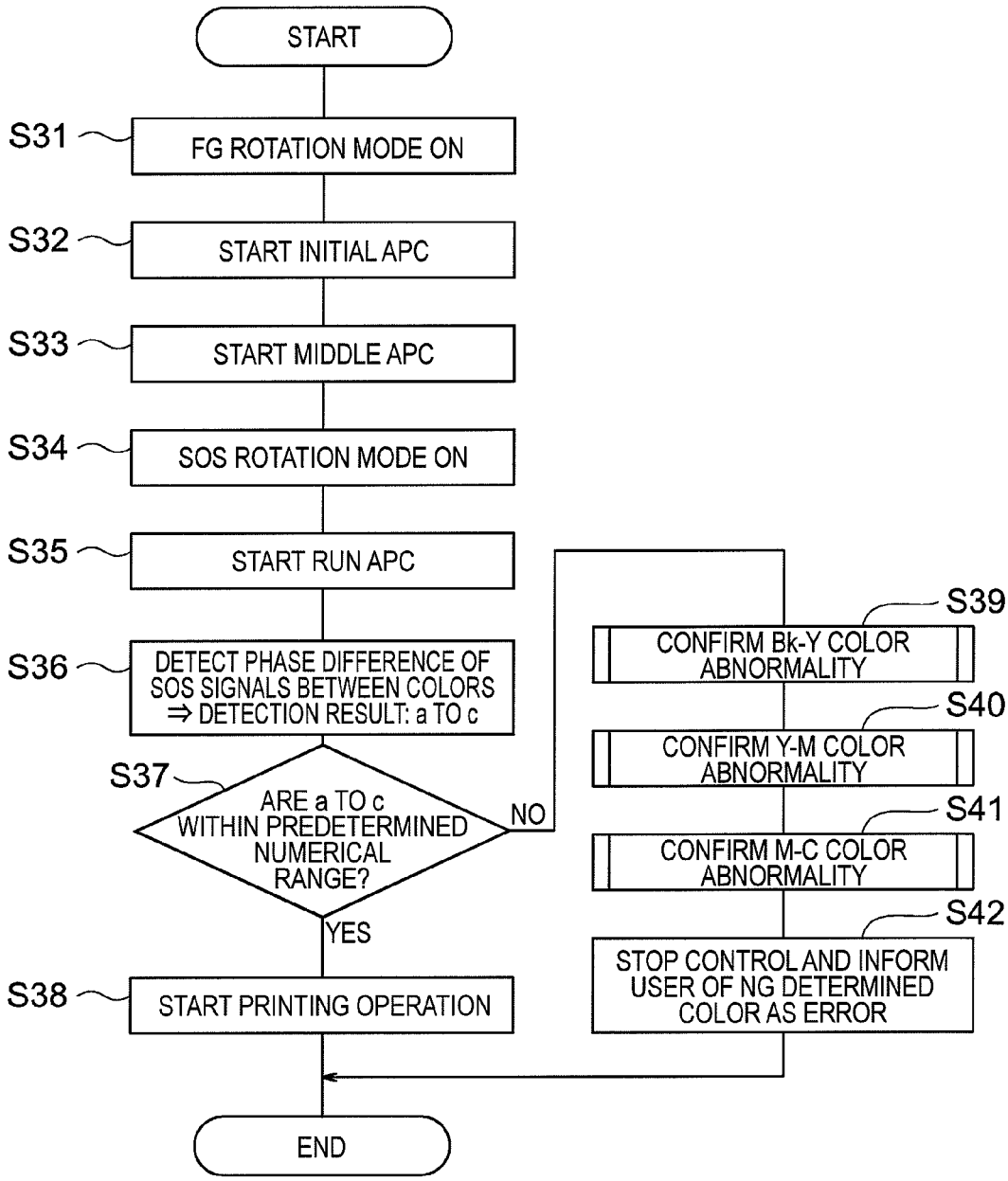
FIG. 20 is a flow chart of another exemplary procedure performed by a controller using the circuit of FIG. 13 of the image forming apparatus according to one exemplary embodiment of the present invention.

FIG. 20 is a flow chart of another exemplary procedure performed by the controller 81 using the circuit of FIG. 13.

Steps S31 to S38 in FIG. 20 are equal to Steps S1 to S8 in FIG. 14, and therefore, a detailed explanation of which will not be repeated. Here, the initial APC, the MIDDLE APC and the like are also simultaneously performed in the image forming parts 2 of all colors. For a detection result in Step S36, a detection result of the phase difference detection circuit 101Bk is assumed as "a", a detection result of the phase difference detection circuit 101Y is assumed as "b", and a detection result of the phase difference detection circuit 101M is assumed as "c". Next, if it is determined that the phase difference detected in Step S36 is not within a preset numerical range (N in Step S37), a Bk-Y abnormality confirmation process (Step S39), a Y-M abnormality confirmation process (Step S40) and an M-C abnormality confirmation process (Step S41) are performed, which will be described later. In this case, since the SOS rotation mode is not normally operated in any image forming part 2, a printing operation of the image forming apparatus 1 is controlled to be stopped and a message is displayed on the touch panel display 95 to inform a user of an error (Step S42). Since it can be seen from this error information that an exposing unit of which an image forming part 2 has a purposive abnormality in Step S39 to S41, which will be described later, it is informed that an exposing unit of what color has abnormality.

Figure 21:
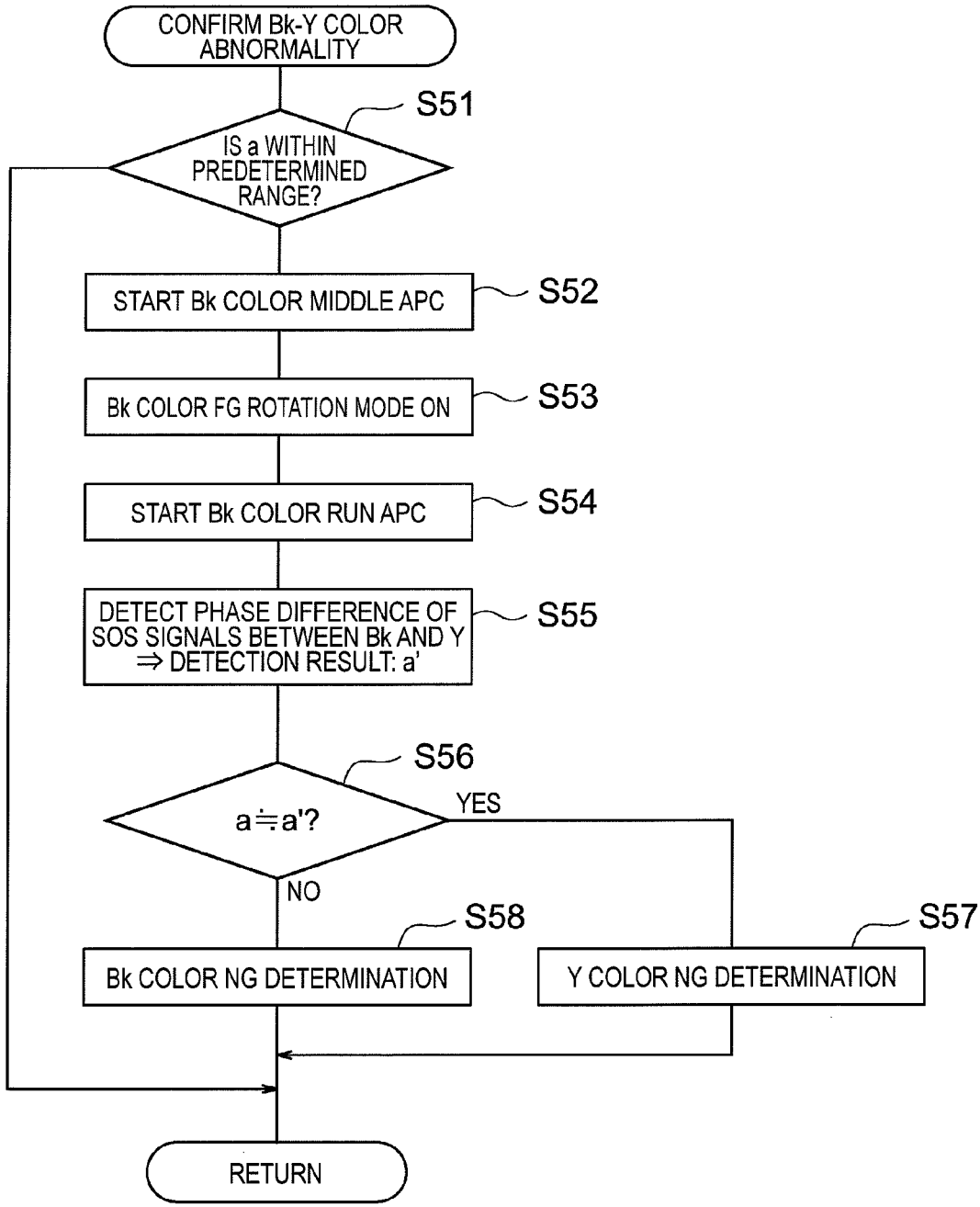
FIG. 21 is a flow chart of a Bk-Y abnormality confirmation process of the image forming apparatus according to one exemplary embodiment of the present invention.

FIG. 21 is a flow chart of the Bk-Y abnormality confirmation process (Step S39).

In this process, if the detection result a is within the preset numerical range (Y in Step S51), it does not mean that the SOS rotation mode is not normally operated, and the process is ended. If the detection result a is not within the preset numerical range (N in Step S51), the MIDDLE APC starts for the image forming part 2Bk (Step S52), the FG rotation mode is turned ON for the image forming part 2Bk (Step S53), and the Run APC starts for the image forming part 2Bk (Step S54). Next, the phase difference detection circuit 101Bk again detects the phase difference between the SOS signal of the image forming part 2Bk and the SOS signal of the adjacent image forming part 2Y and assumes a result of the detection as "a'" (Step S55). Next, it is determined whether or not the detection result a and the detection result a' are substantially equal to each other within the preset numerical range (Step S56). If the detection result a is substantially equal to the detection result a' (Y in Step S56), it may be determined that the yellow image forming part 2Y has an abnormality (Step S57). Otherwise (N in Step S56), it may be determined that the black image forming part 2Bk has an abnormality (Step S58).

Figure 22:
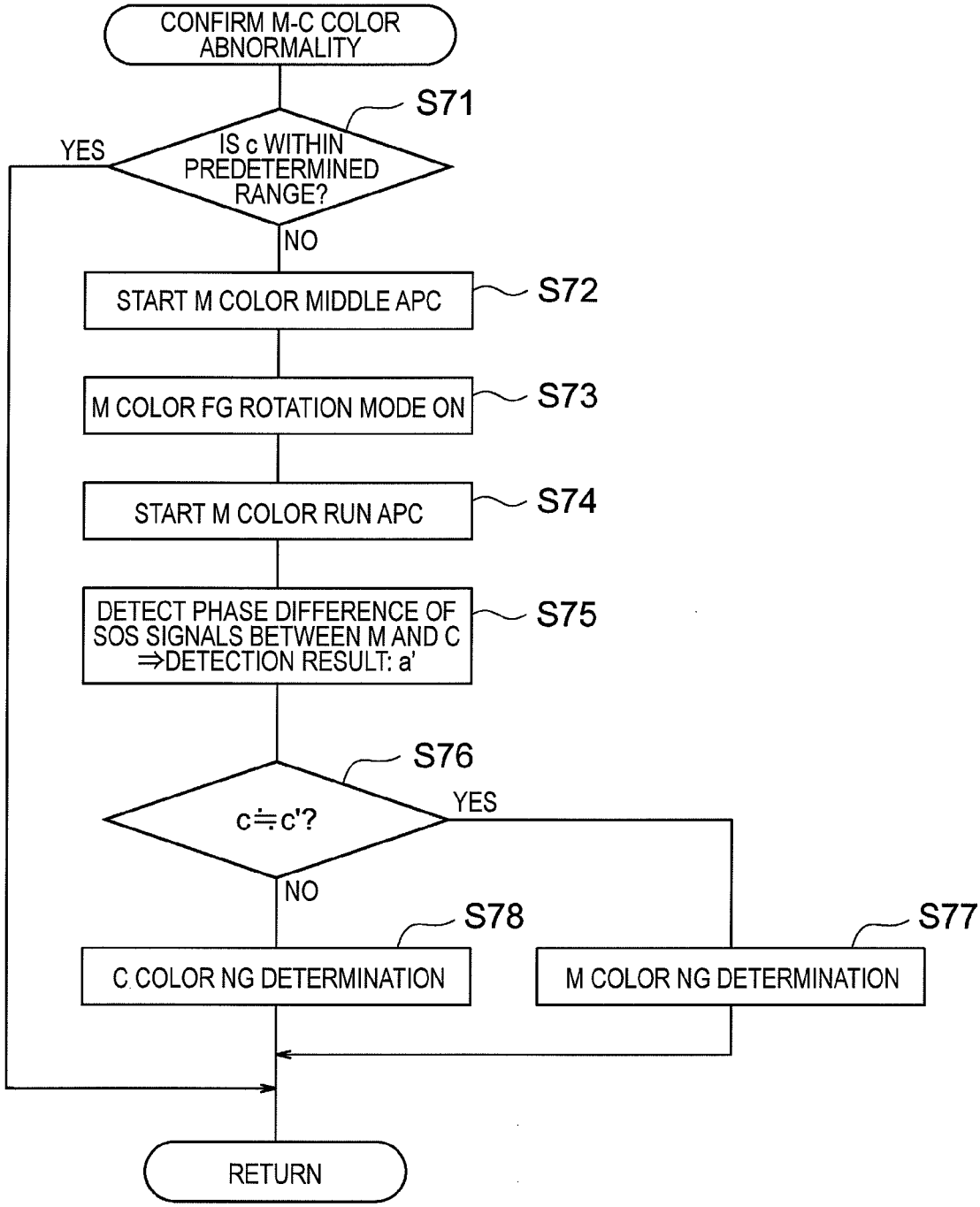
FIG. 22 is a flow chart of a Y-M abnormality confirmation process of the image forming apparatus according to one exemplary embodiment of the present invention.

FIG. 22 is a flow chart of the Y-M abnormality confirmation process (S40).

The processes of Steps S61 to S68 are equal to the process of FIG. 21, and therefore, a detailed explanation of which will not be repeated. With such processes, it can be determined that the yellow image forming part 2Y has an abnormality (Step S67) and it can be determined that the magenta image forming part 2M has an abnormality (Step S68).

Figure 23:
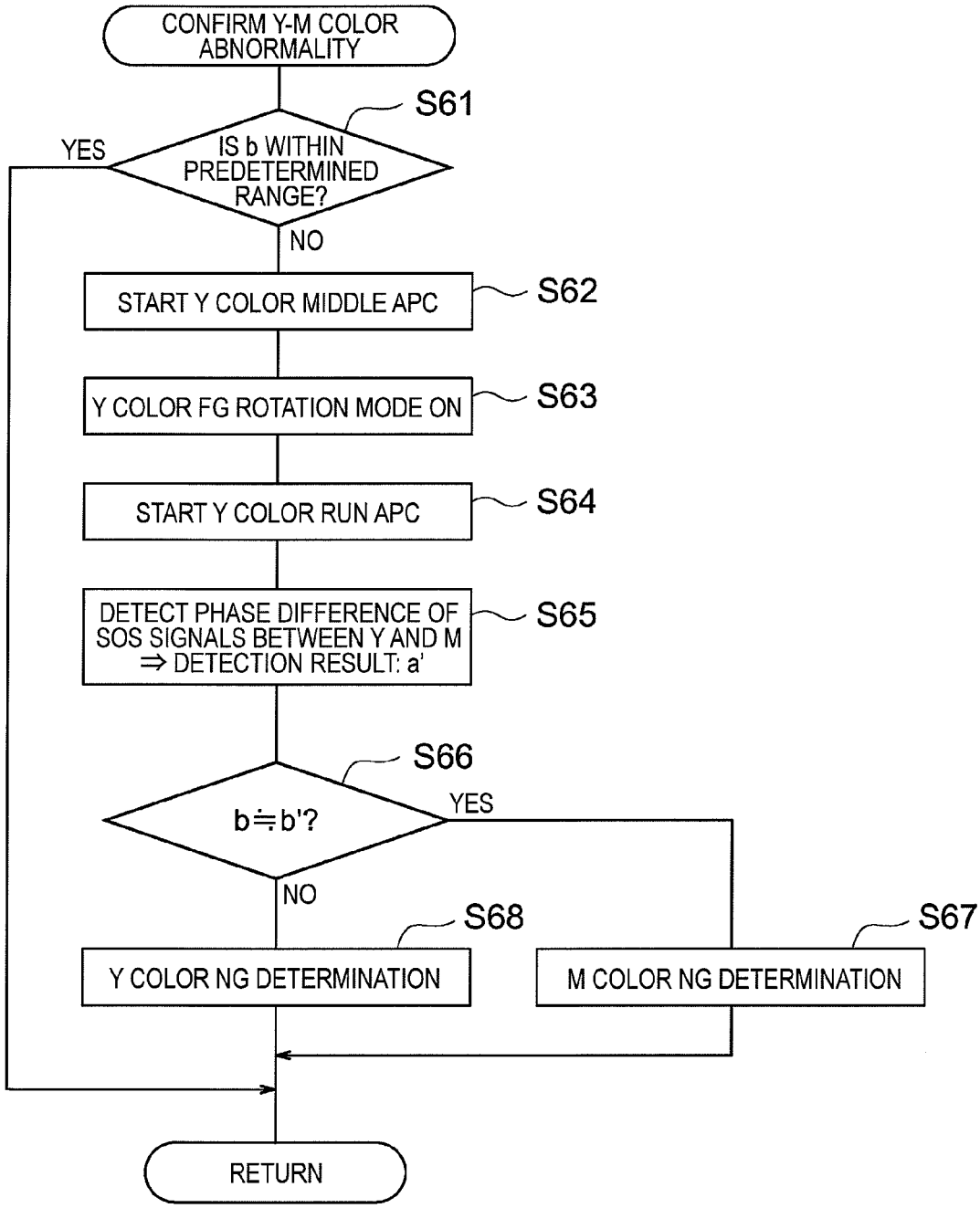
FIG. 23 is a flow chart of an M-C abnormality confirmation process of the image forming apparatus according to one exemplary embodiment of the present invention.

FIG. 23 is a flow chart of the M-C abnormality confirmation process (Step S41).

The processes of Steps S71 to S78 are also equal to the process of FIG. 21, and therefore, a detailed explanation of which will not be repeated. With such processes, it can be determined that the magenta image forming part 2M has an abnormality (Step S77) and it can be determined that the cyan image forming part 2C has an abnormality (Step S78).

In these processes, although the image forming parts 2 of all of the colors are switched over to the SOS rotation mode and then return to the FG rotation mode one by one, it may be configured that the image forming parts 2 of all of the colors are switched over to the SOS rotation mode for all of the image forming parts 2, return to the FG rotation mode at once for all of the image forming parts 2, and thereafter, return to the SOS rotation mode one by one of the image forming parts 2 of each color.

Figure 24:
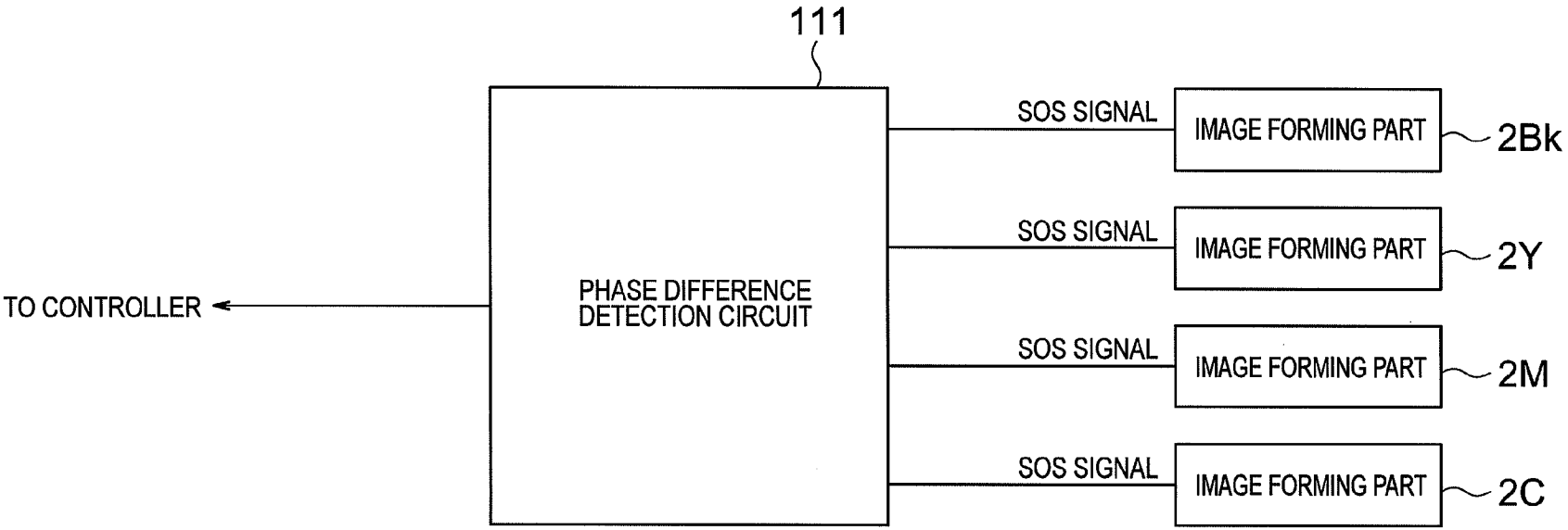
FIG. 24 is a block diagram showing another circuit configuration to detect whether or not the polygon motor 72 is switched over to a procedure based on an SOS signal when a procedure of the polygon motor based on the SOS signal of the image forming apparatus according to one exemplary embodiment of the present invention is carried out.

FIG. 24 is a block diagram showing another circuit configuration to detect whether or not the polygon motor 72 switches over to a procedure based on the SOS signal when a procedure of the polygon motor 72 based on the SOS signal is started.

That is, the circuit configuration of FIG. 13 may be replaced with the circuit configuration of FIG. 24. In the circuit configuration of FIG. 24, a phase difference detection circuit 111 detects a phase difference between SOS signals of a combination of all of the image forming parts 2 and outputs a result of the detection to the controller 81.

Figure 25:
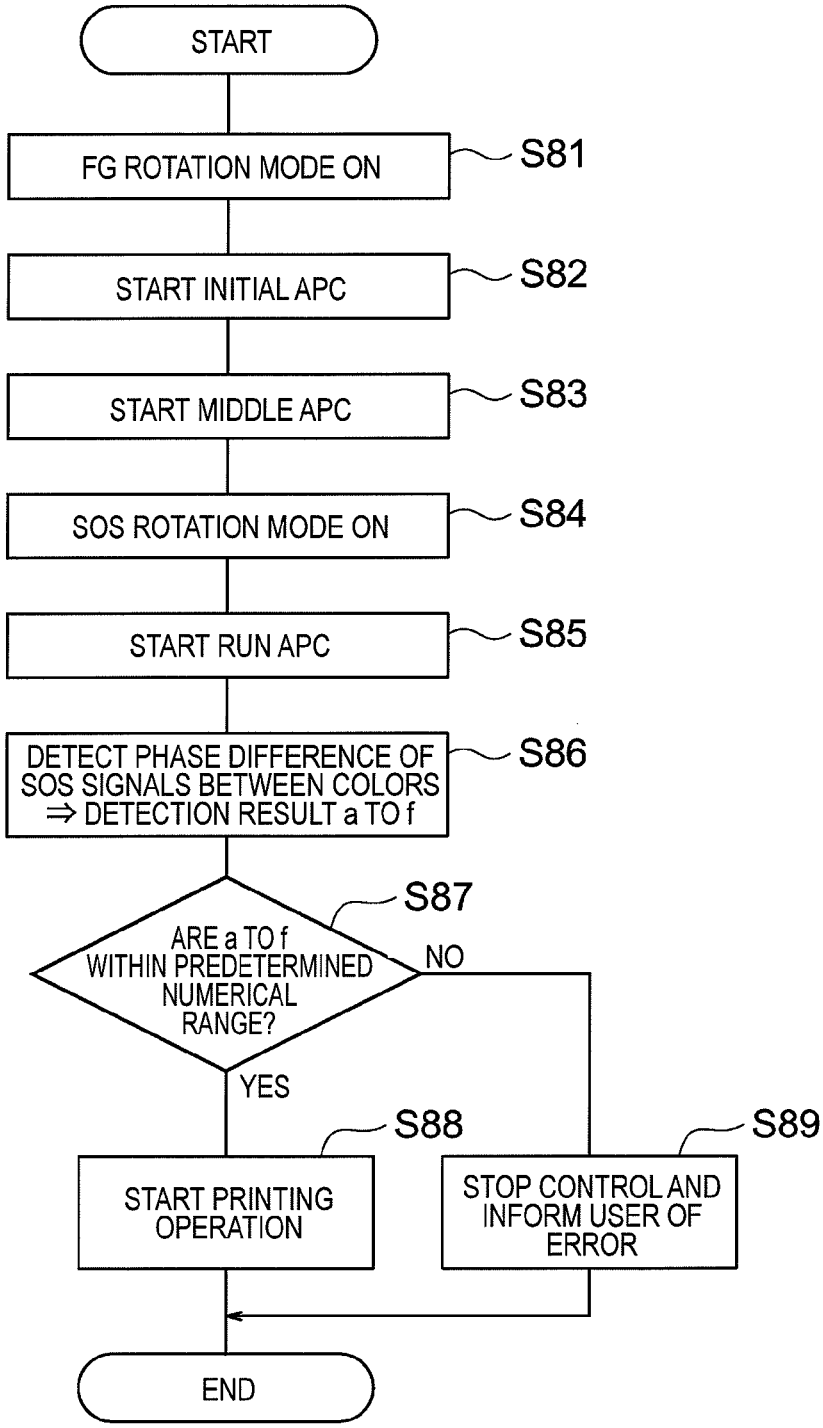
FIG. 25 is a flow chart of a process performed by a controller using the circuit of FIG. 24 of the image forming apparatus according to one exemplary embodiment of the present invention.

FIG. 25 is a flow chart of a process performed by the controller 81 using the circuit of FIG. 24.

First, the controller 81 turns ON the FG rotation mode at the start of the rotation of the polygon mirror 59 (Step S81). Then, a rotation control of the polygon motor 72 based on the FG signal starts. Next, an initial APC starts (Step S82).

Then, the polygon mirror 59 begins to rotate and the SOS signal begins to be input, and next the MIDDLE APC starts (Step S83). In addition, the initial APC, MIDDLE APC and the like are simultaneously performed in the image forming parts 2 for all of the colors. In addition, since the SOS signal begins to be input, the SOS rotation mode is turned ON (Step S84). Next, the Run APC starts (Step S85).

Next, each phase difference detection circuit 101 detects a phase difference of the SOS signals for all combinations of the image forming parts 2 of various colors (Step S86). Since the number of image forming parts 2 is four, the number of all of the combinations thereof is six. Detection results of the phase difference of the SOS signals for all the combinations are set to be a to f. Then, it is determined whether or not all the phase differences of the detection results a to f are within a preset numerical range (here about 0° or 360°) (Step S87).

If all the detected phase differences are within the preset numerical range (Y in Step S87), since it means that the SOS rotation mode in each image forming part 2 is normally operated, the image forming apparatus 1 starts a printing operation (Step S88). If this is not the case (N in Step S87), since it may mean that the SOS rotation mode in any image forming part 2 is not normally operated, a printing operation of the image forming apparatus 1 is controlled to stop and a message is displayed on the touch panel display 95 to inform a user of an error (Step S89).

Figure 26:
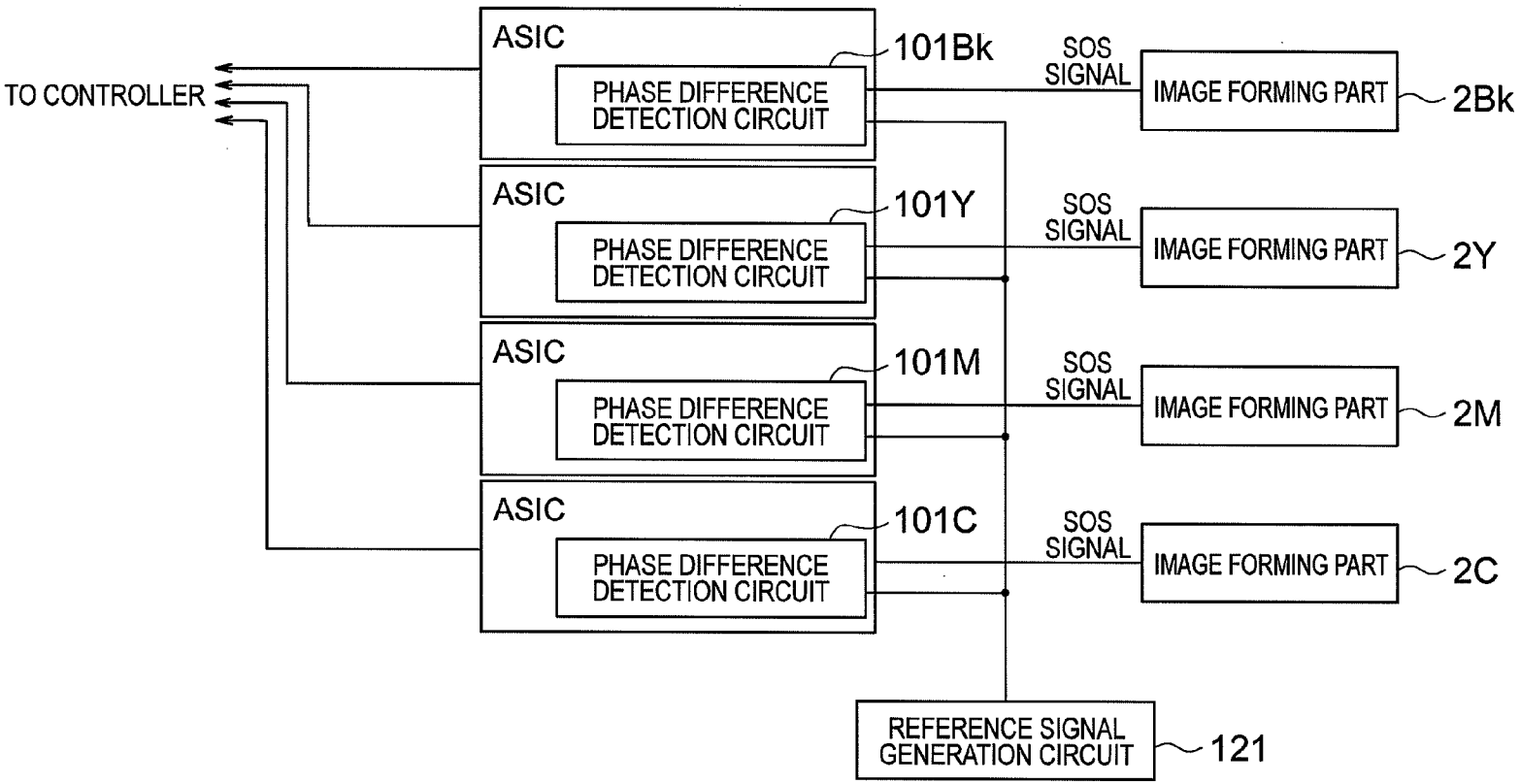
FIG. 26 is a block diagram showing still another circuit configuration to detect whether or not the polygon motor 72 is switched over to a procedure based on an SOS signal when a procedure of the polygon motor based on the SOS signal of the image forming apparatus according to one exemplary embodiment of the present invention is started.

FIG. 26 is a block diagram showing still another circuit configuration to detect whether or not the polygon motor 72 switches over to a procedure based on the SOS signal when a procedure of the polygon motor 72 based on the SOS signal is started.

The circuit configuration of FIG. 13 may be replaced with the circuit configuration of FIG. 26. In the circuit configuration of FIG. 26, a phase difference detection circuit 101 detects a phase difference between an SOS signal output from each image forming part 2 and a reference signal output from a reference signal generation circuit 121 and outputs a result of the detection to the controller 81. As the reference signal output from the reference signal generation circuit 121, a reference clock input to the PLL control circuit 70, a signal having the same period (and different phase from) as the SOS signal, etc. may be used.

If the phase difference between the SOS signal and the reference signal in any phase difference detection circuit 101 has no preset relationship, it is determined that there occurs an abnormality in any image forming part 2, the image forming apparatus 1 is stopped, and a user is informed of the error by a message, as described in the above examples.

Figure 27:
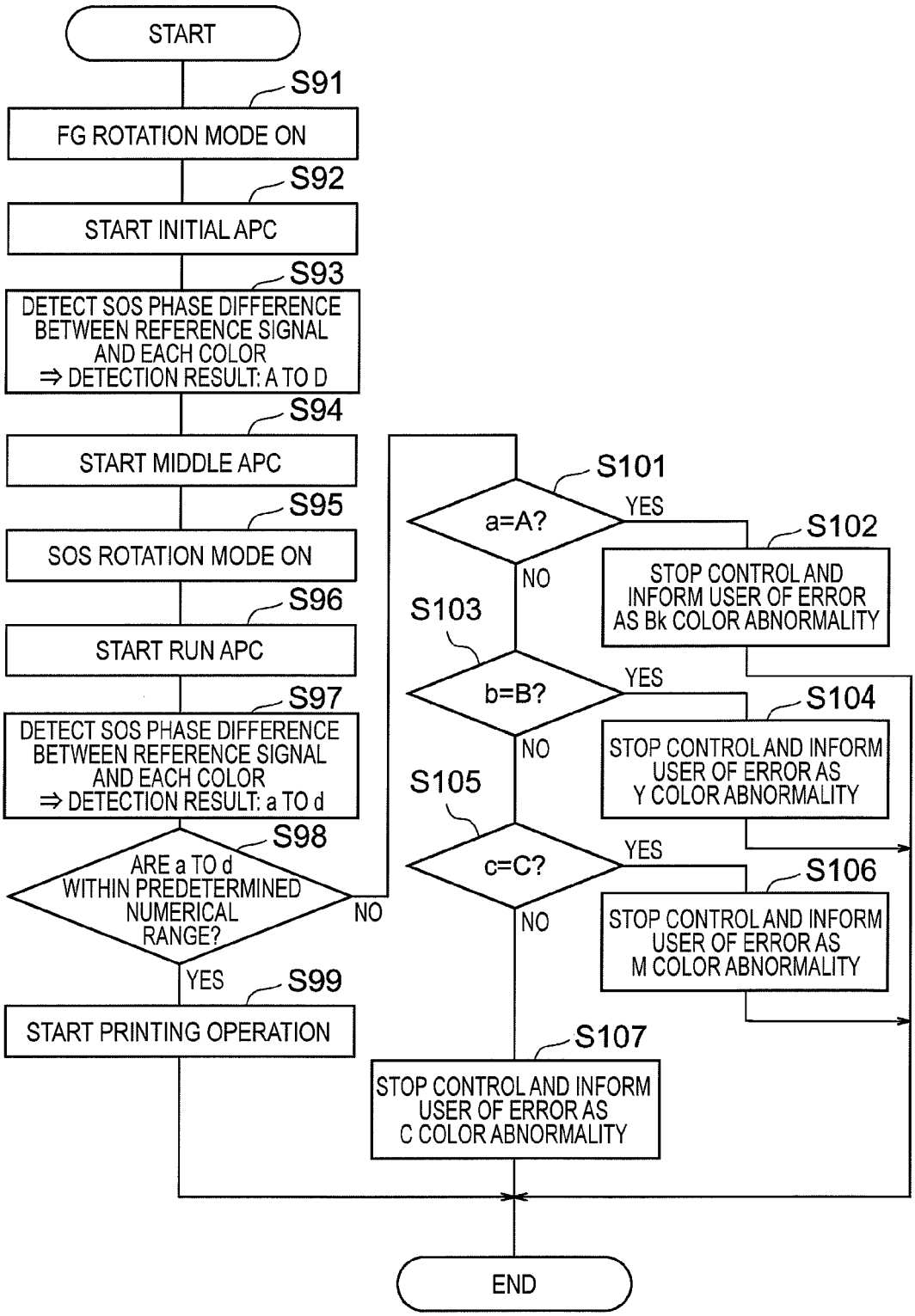
FIG. 27 is a flow chart of a process performed by a controller using the circuit of FIG. 26 of the image forming apparatus according to one exemplary embodiment of the present invention.

FIG. 27 is a flow chart of a process performed by the controller 81 using the circuit of FIG. 26.

First, the controller 81 turns ON the FG rotation mode at the start of the rotation of the polygon mirror 59 (Step S91). Then, a rotation control of the polygon motor 72 based on the FG signal starts. Next, an initial APC starts (Step S92).

Next, in the FG rotation mode, each phase difference detection circuit 101 detects a phase difference of the SOS signal in each image forming part 2 and a reference signal (Step S93). Detection results of the phase difference are set from A to D.

Then, the polygon mirror 59 begins to rotate and the SOS signal begins to be input, and next the MIDDLE APC starts (Step S94). In addition, the initial APC, MIDDLE APC and the like are simultaneously performed in the image forming parts 2 of all of the colors. In addition, since the SOS signal begins to be input, the SOS rotation mode is turned ON (Step S95). Next, the Run APC starts (Step S96).

Next, in the SOS rotation mode, each phase difference detection circuit 101 detects a phase difference between the SOS signal in each image forming part 2 and a reference signal (Step S97). Detection results of the phase difference are set to from a to d. Then, it is determined whether or not all the phase differences of the detection results a to d are within a preset numerical range (here about 0° or 360°) (Step S98).

If all the phase differences are within the preset numerical range (Yin Step S98), since it means that the SOS rotation mode in each image forming part 2 is normally operated, the image forming apparatus 1 starts a printing operation (Step S99).

If this is not the case (N in Step S98), it is determined whether or not the detection results a and A are equal to each other (Step S101). If equal (Y in Step S101), the image forming apparatus 1 is stopped and a user is informed that there is an abnormality in the black image forming part 2Bk (Step S102). If the detection results a and A are not equal to each other (N in Step S101), it is determined whether or not the detection results b and B are equal to each other (Step S103). If equal (Yin Step S103), the image forming apparatus 1 is stopped and a user is informed that there is an abnormality in the yellow image forming part 2Y (Step S104). If the detection results b and B are not equal to each other (N in Step S103), it is determined whether or not the detection results c and C are equal to each other (Step S105). If equal (Y in Step S105), the image forming apparatus 1 is stopped and a user is informed that there is an abnormality in the magenta image forming part 2M (Step S106). If the detection results c and C are not equal to each other (N in Step S105), the image forming apparatus 1 is stopped and a user is informed that there is abnormality in the cyan image forming part 2C (Step S107).

Figure 28:
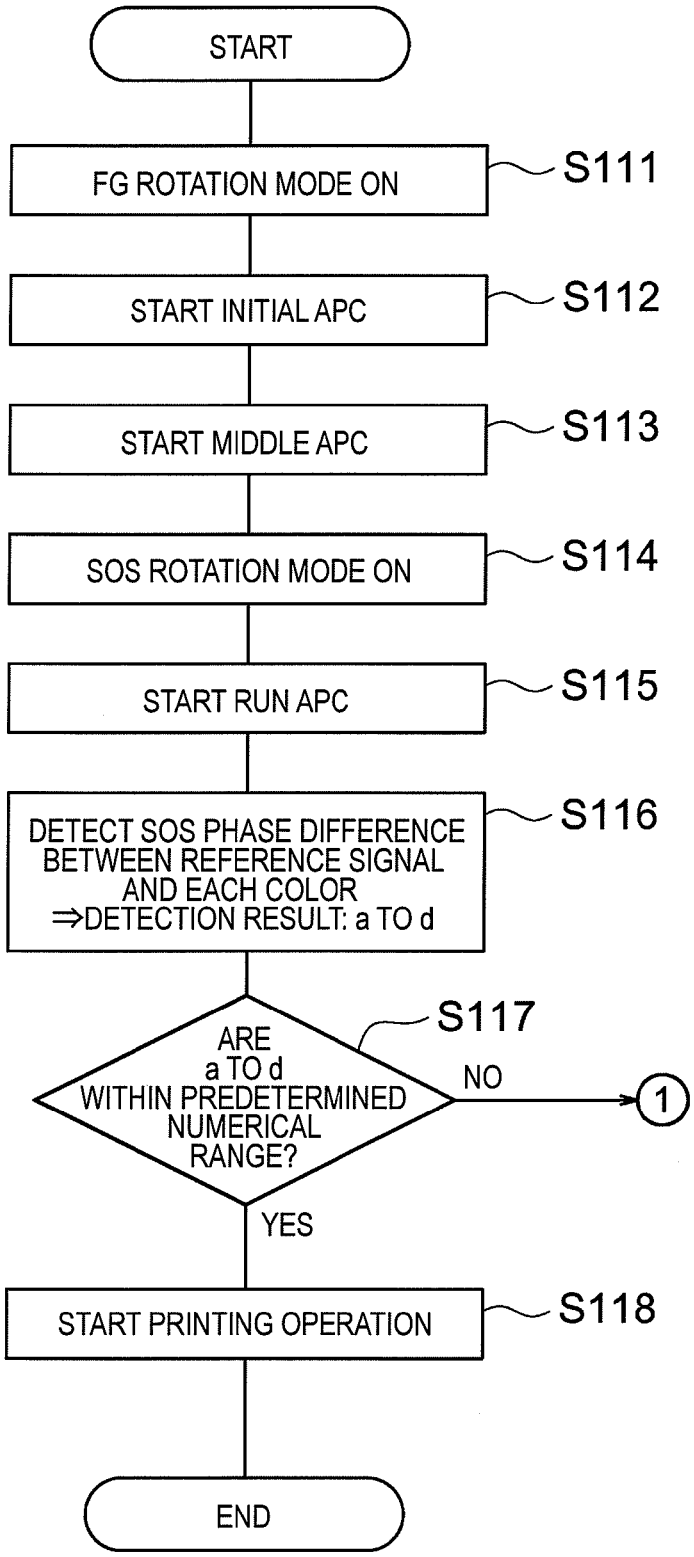
FIG. 28 is a flow chart of another exemplary process performed by a controller using the circuit of FIG. 26 of the image forming apparatus according to one exemplary embodiment of the present invention.
Figure 29:
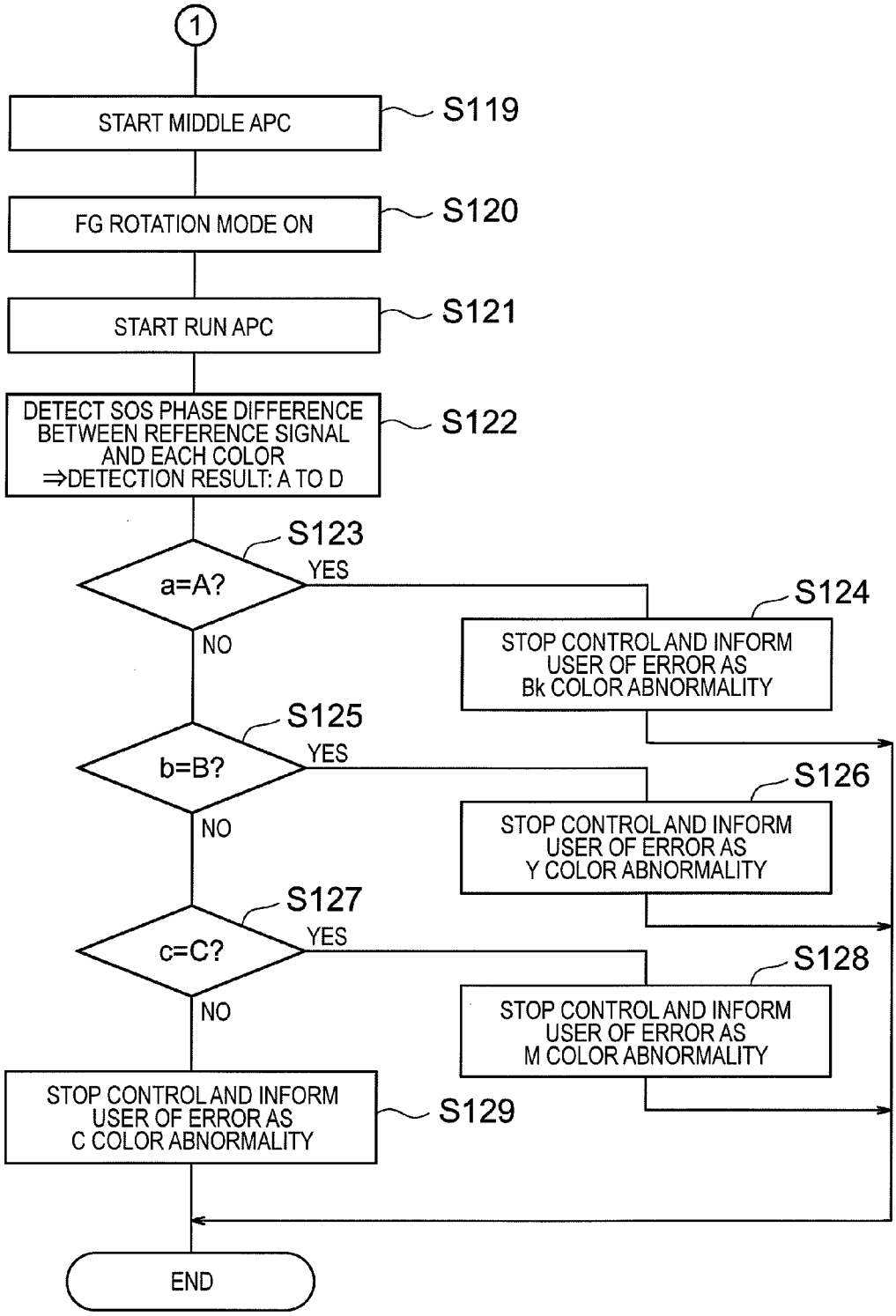
FIG. 29 is a flow chart of still another exemplary process performed by a controller using the circuit of FIG. 26 of the image forming apparatus according to one exemplary embodiment of the present invention.

FIGS. 28 and 29 are flow charts of another exemplary process performed by the controller 81 using the circuit of FIG. 26.

First, the controller 81 turns ON the FG rotation mode at the start of the rotation of the polygon mirror 59 (Step S111). Then, a rotation control of the polygon motor 72 based on the FG signal starts. Next, an initial APC starts (Step S112).

Then, the polygon mirror 59 begins to rotate and the SOS signal begins to be input, and next the MIDDLE APC starts (Step S113). In addition, the initial APC, MIDDLE APC and the like are simultaneously performed in the image forming parts 2 for all of the colors. In addition, since the SOS signal begins to be input, the SOS rotation mode is turned ON (Step S114). Next, the Run APC starts (Step S115).

Next, in the SOS rotation mode, each phase difference detection circuit 101 detects a phase difference between the SOS signal in each image forming part 2 and a reference signal (Step S116). Detection results of the phase difference are set to be a to d. Then, it is determined whether or not all the phase differences of the detection results a to d are within a preset numerical range (here about 0° or 360°) (Step S117).

If all the phase differences are within the preset numerical range (Y in Step S117), since it means that the SOS rotation mode in each image forming part 2 is normally operated, the image forming apparatus 1 starts a printing operation (Step S118).

If this is not the case (N in Step S118), the MIDDLE APC starts (Step S119) and the FG rotation mode is again turned ON (Step S120). Next, the Run APC starts (Step S121). Then, in the FG rotation mode, each phase difference detection circuit 101 detects a phase difference of the SOS signal in each image forming part 2 and a reference signal (Step S122). Detection results of the phase difference are set to be A to D.

Next, it is determined whether or not the detection results a and A are equal to each other (Step S123). If they are equal (Y in Step S123), the image forming apparatus 1 is stopped and a user is informed that there is an abnormality in the black image forming part 2Bk (Step S124). If the detection results a and A are not equal to each other (N in Step S123), it is determined whether or not the detection results b and B are equal to each other (Step S125). If equal (Yin Step S125), the image forming apparatus 1 is stopped and a user is informed that there is an abnormality in the yellow image forming part 2Y (Step S126). If the detection results b and B are not equal to each other (N in Step S125), it is determined whether or not the detection results c and C are equal to each other (Step S127). If they are equal (Y in Step S127), the image forming apparatus 1 is stopped and a user is informed that there is abnormality in the magenta image forming part 2M (Step S128). If the detection results c and C are not equal to each other (N in Step S127), the image forming apparatus 1 is stopped and a user is informed that there is an abnormality in the cyan image forming part 2C (Step S129).

All the processes of FIGS. 27, 28 and 29 determine whether or not there is an abnormality in one of the image forming parts 2 and specify which image forming part 2 has the abnormality.

Figure 30:
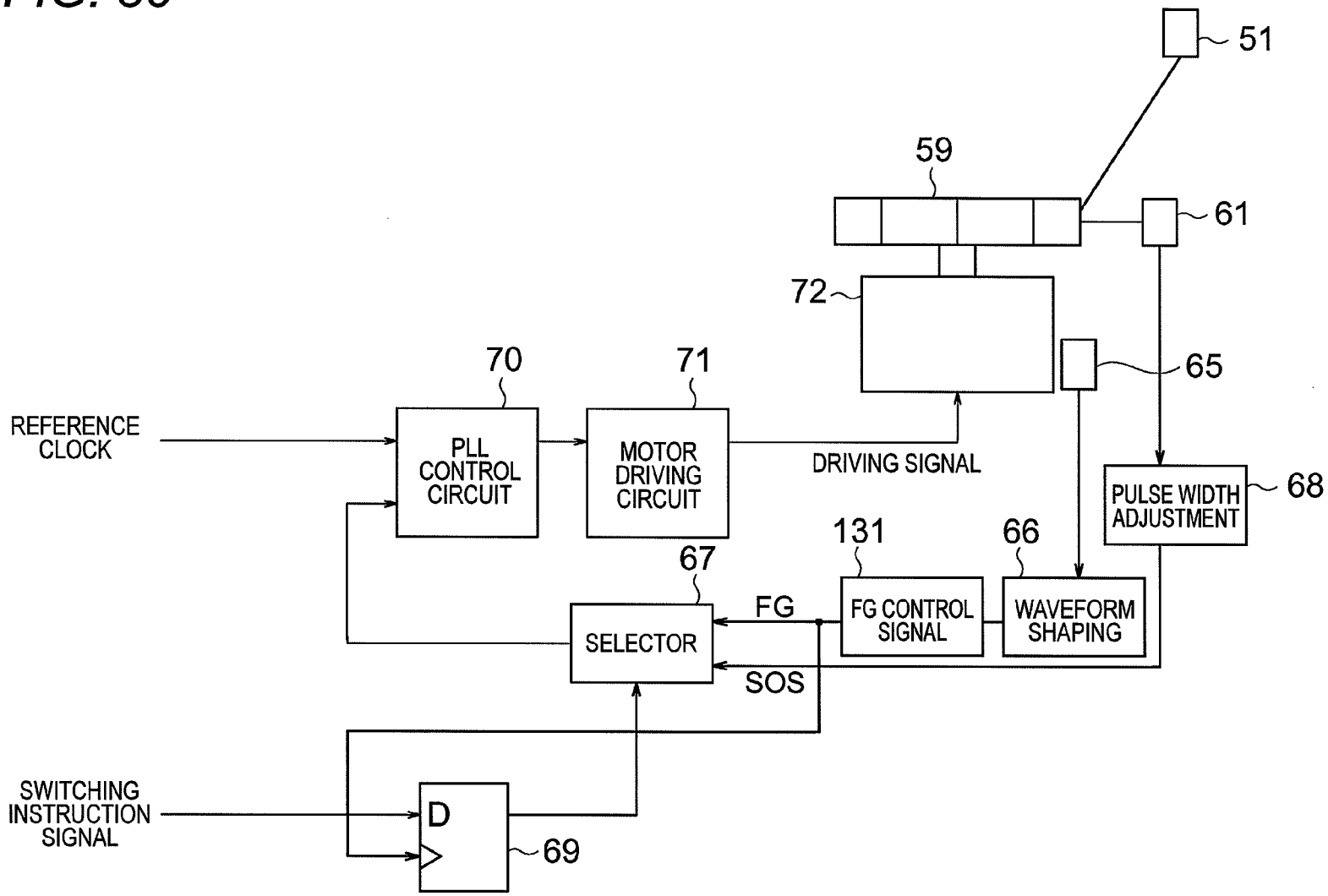
FIG. 30 is a circuit diagram of another exemplary control system of the polygon motor of the image forming apparatus according to one exemplary embodiment of the present invention.

FIG. 30 is a circuit diagram of another exemplary control system of the polygon motor 72.

The circuit of FIG. 30 is different from that of FIG. 7 in that the former has an FG signal control circuit 131 to control the FG signal output from the waveform shaping circuit 66 to the selector 67.

Typically, even when the FG signal is varied after the SOS rotation mode, it has no effect on the control of the polygon motor 72.

Accordingly, the FG signal control circuit 131 varies the FG signal, such as by changing its phase or stopping the signal itself, after the FG rotation mode. Accordingly, if there is a variation in a phase difference between signals compared to the circuit of FIGS. 13, 24 and 26, it may be determined that the control of the polygon motor 72 is unsuccessful after the SOS rotation mode.

In addition, in the above examples, when only a monochrome (for example, black) image is formed, it is not determined whether or not the polygon motor 72 is normally switched over to the SOS rotation mode. Moreover, in the above examples, if it is detected that the polygon motor 72 is not normally switched over to the SOS rotation mode, image positions (registrations) of various colors may be adjusted by known means.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An exposing device comprising; a plurality of exposing units which forms a latent image, wherein each of the plurality of exposing units includes:

an exposure light source;

a rotating polyhedron that reflects light from the exposure light source to exposedly scan a photoconductor with the reflected light while rotating;

a driving source that rotates the rotating polyhedron;

a first detecting unit that detects the number of rotations of the driving source;

a second detecting unit that detects the light from the exposure light source at a position, the light being reflected by the rotating polyhedron;

a control unit that performs a first control of the driving source based on a detection signal of the first detecting unit at a start of the rotation of the rotating polyhedron and thereafter performs a second control of the driving source based on a detection signal of the second detecting unit; and a phase difference detecting unit that determines whether a phase difference between the detection signal of the second detecting unit of each of the exposing units is less than a predetermined phase difference when the first control is switched over to the second control by the control unit of the exposing unit.

2. The exposing device according to claim 1, wherein the phase difference detecting unit causes the first control to switch over to the second control for each exposing unit in turn, determines whether the phase difference is less than the predetermined phase difference for each exposing unit before and after the switch over, and, if the phase difference is less than the predetermined phase difference for each exposing unit carries out exposing using the plurality of exposing units to form the latent image.

3. The exposing device according to claim 2, wherein if the phase difference is not less than the predetermined phase difference a user is informed that an abnormality occurs in the exposing units and informed about the exposing unit that has the abnormality.

4. The exposing device according to claim 1, wherein, if the phase difference between the detection signal of the second detecting unit of each of the exposing units is less than the predetermined phase difference when the first control is switched over to the second control by the control unit of the exposing unit, it is determined for each exposing unit whether or not a phase difference between detection signals of the second detecting unit in the first control and the second control are less than the predetermined phase difference, and carries out exposing using the plurality of exposing units to form the latent image based on the determination.

5. The exposing device according to claim 1, wherein if the phase difference between the detection signal of the second detecting unit of each of the exposing units is not less than a predetermined phase difference a user is informed that an abnormality occurs in the exposing units.

6. An image forming apparatus comprising:

a plurality of image forming parts that forms an image by an electro-photographic method, each of the plurality of image forming parts including a plurality of exposing units which forms a latent image, wherein each of the plurality of exposing units includes:

an exposure light source;

a rotating polyhedron that reflects light from the exposure light source to exposedly scan a photoconductor with the reflected light while rotating;

a driving source that rotates the rotating polyhedron;

a first detecting unit that detects the number of rotations of the driving source;

a second detecting unit that detects the light from the exposure light source at a position, the light being reflected by the rotating polyhedron; and a control unit that performs a first control of the driving source based on a detection signal of the first detecting unit at a start of the rotation of the rotating polyhedron and thereafter performs a second control of the driving source based on a detection signal of the second detecting unit, and a phase difference detecting unit that determined whether a phase difference between the detection signal of the second detecting unit of each of the exposing units is less than a predetermined phase difference when the first control is switched over to the second control by the control unit of the exposing unit.

7. The image forming apparatus according to claim 6, wherein the image formed by the plurality of image forming parts is a color image.

8. The image forming apparatus according to claim 6, wherein the phase difference detecting unit causes the first control to switch over to the second control for each exposing unit in turn, determines whether the phase difference is less than the predetermined phase difference for each exposing unit before and after the switch over, and, if the phase difference is less than the predetermined phase difference for each exposing unit carries out exposing using the plurality of exposing units to form the latent image.

9. The image forming apparatus according to claim 6, wherein, if the phase difference between the detection signal of the second detecting unit of each of the exposing units is less than the predetermined phase difference when the first control is switched over to the second control by the control unit of the exposing unit, it is determined for each exposing unit whether or not a phase difference between detection signals of the second detecting unit in the first control and the second control are less than the predetermined phase difference, and carries out exposing using the plurality of exposing units to form the latent image based on the determination.

10. A computer readable medium storing a program causing a computer to execute a process for controlling exposure, the process comprising:

forming a latent image by an electro-photographic method, wherein the forming includes:

rotating an rotating polyhedron;

reflecting light from an exposure light source to exposedly scan a photoconductor with the reflected light while the rotating;

detecting, as a first detecting, the number of rotations of the rotating polyhedron;

detecting, as a second detecting, the light from the exposure light source at a position, the light being reflected by the rotating polyhedron;

performing a first control of the rotating based on a detection signal of the first detecting at a start of the rotating; and performing a second control of the rotating based on a detection signal of the second detecting, and determining whether a phase difference between the detection signal of the second detecting is less than a predetermined phase difference when the first control is switched over to the second control.

11. The process according to claim 10, wherein the formed latent image by the electro-photographic method is used to form a color image.

* * * * *